US011350796B2

(12) United States Patent
Ophardt et al.

(10) Patent No.: US 11,350,796 B2
(45) Date of Patent: Jun. 7, 2022

(54) FLUID DISPENSER WITH SENSOR FOR DETERMINING THE VOLUME OF FLUID IN A COLLAPSIBLE CONTAINER

(71) Applicant: OP-Hygiene IP GmbH, Niederbipp (CH)

(72) Inventors: Heiner Ophardt, Arisdorf (CH); Cuneyt Tezcan, Burlington (CA); Dusan Stan, Stoney Creek (CA)

(73) Assignee: OP-Hygiene IP GmbH, Niederbipp (CH)

( * ) Notice: Subject to any disclaimer, the term of this patent is extended or adjusted under 35 U.S.C. 154(b) by 0 days.

(21) Appl. No.: 16/944,096

(22) Filed: Jul. 30, 2020

(65) Prior Publication Data

US 2021/0030216 A1 Feb. 4, 2021

(30) Foreign Application Priority Data

Aug. 1, 2019 (CA) ..... CA 3050975

(51) Int. Cl.
*A47K 5/12* (2006.01)

(52) U.S. Cl.
CPC ..... *A47K 5/1211* (2013.01); *A47K 5/1217* (2013.01)

(58) Field of Classification Search
CPC .... A47K 5/1211; A47K 5/1217; A47K 5/122; B65D 1/0292; B65D 1/32; B65D 1/0223
USPC ..... 222/94–95, 107, 105; 220/4.01, 606
See application file for complete search history.

(56) References Cited

U.S. PATENT DOCUMENTS 2,688,424 A * 9/1954 Keiter ..... G01F 11/082 222/215
4,372,455 A * 2/1983 Cochran ..... B29C 49/0073 215/385
5,083,678 A * 1/1992 Waring ..... A47K 5/122 222/105
6,158,620 A * 12/2000 Polan ..... B65D 1/0292 222/107
7,357,267 B1 * 4/2008 Shimada ..... B65D 1/0292 215/381
7,530,475 B2 * 5/2009 Ophardt ..... B65D 1/0292 220/666
8,365,954 B2 * 2/2013 Ophardt ..... B65D 35/02 222/95
8,944,288 B2 * 2/2015 Ciavarella ..... B05B 11/00412 222/95

(Continued)

*Primary Examiner* — Charles P. Cheyney
(74) *Attorney, Agent, or Firm* — Thorpe North & Western, LLP

(57) ABSTRACT

A method of determining the volume of fluid contained in a collapsible bottle, the collapsible bottle containing a fluid to be dispensed from a fluid dispenser. The fluid dispenser has a distance measuring sensor, and the collapsible bottle is coupled to the fluid dispenser so that a preselected surface of the collapsible bottle is positioned in a measurement path of the sensor. The fluid dispenser is activated to dispense an allotment of the fluid from the collapsible bottle, the collapsible bottle collapsing in a predictable manner as the fluid is dispensed from the collapsible bottle. The sensor is used to measure a distance between the sensor and the preselected surface of the collapsible bottle, the distance changing predictably as the collapsible bottle collapses. The volume of the fluid contained in the collapsible bottle is determined based on the distance between the sensor and the preselected surface of the collapsible bottle.

18 Claims, 27 Drawing Sheets

(56) References Cited

U.S. PATENT DOCUMENTS

| | | | | |
|---|---|---|---|---|
| 9,027,788 | B2 | 5/2015 | Ophardt | |
| 9,919,839 | B2 * | 3/2018 | Mirbach | B65D 1/0292 |
| 10,278,550 | B2 | 5/2019 | Ophardt | |
| 2004/0069800 | A1 * | 4/2004 | Piccinino, Jr. | B65D 83/0055 222/105 |
| 2005/0072752 | A1 * | 4/2005 | Yamanaka | B65D 1/0292 215/381 |
| 2009/0114679 | A1 * | 5/2009 | Ophardt | B65D 1/0292 222/105 |
| 2014/0217117 | A1 * | 8/2014 | Mirbach | B05B 11/048 222/95 |
| 2015/0223645 | A1 * | 8/2015 | Ray | B05B 11/048 222/156 |
| 2015/0274375 | A1 * | 10/2015 | Kling | A47K 5/1211 222/103 |
| 2017/0152095 | A1 * | 6/2017 | Soehnlen | B65D 1/0246 |
| 2017/0319014 | A1 | 11/2017 | Ophardt | |
| 2019/0063980 | A1 * | 2/2019 | Kobs | A47K 5/16 |

* cited by examiner

FLUID DISPENSER WITH SENSOR FOR DETERMINING THE VOLUME OF FLUID IN A COLLAPSIBLE CONTAINER

FIELD OF THE INVENTION

This invention relates to hand cleaning fluid dispensers, and more particularly to dispensers that have a sensor for determining the volume of fluid remaining in a fluid reservoir of the dispenser.

BACKGROUND OF THE INVENTION

Fluid dispensers are well known for dispensing hand cleaning fluids such as soap or hand sanitizer. Such dispensers typically carry a fluid reservoir containing a supply of the hand cleaning fluid to be dispensed. The fluid reservoirs need to be replaced or refilled periodically when the supply of hand cleaning fluid contained therein is depleted.

Various methods are known for determining or predicting the amount of fluid remaining in a fluid reservoir, so that the fluid reservoir can be promptly refilled or replaced when needed. For example, it is known to use a counter to count the number of times that a fluid dispenser has been activated, and to use this information, together with the known or estimated volume of fluid that is dispensed with each activation, to estimate the total amount of fluid remaining in the reservoir. Such arrangements can have a number of disadvantages, including for example the requirement that the counter be reset by an appropriate mechanism each time the reservoir is replaced or refilled. Furthermore, if the amount of fluid that is dispensed with each activation is not always the same, as may occur with some manually operated dispensers, then it may not be possible for such systems to accurately calculate the amount of fluid remaining in the reservoir.

An alternative arrangement for estimating the amount of fluid in a fluid reservoir is disclosed in U.S. Pat. No. 9,027,788 to Ophardt et al., issued May 12, 2015, which is incorporated herein by reference. U.S. Pat. No. 9,027,788 teaches the use of an infrared emitter and an infrared sensor which are arranged on a housing of a fluid dispenser. The infrared emitter and the infrared sensor are positioned adjacent to a fluid reservoir in the form of a collapsible bottle. Infrared radiation is emitted from the infrared emitter, passes through a rear wall of the bottle and through the fluid contained in the bottle, and is reflected from a front wall of the bottle towards the infrared sensor. The collapsible bottle has a bottom end that rises upwardly as the fluid contained within the bottle is dispensed and the bottle collapses. When the bottle is nearly empty, the bottom of the bottle rises above the infrared emitter and out of the path of the emitted radiation. This causes the amount of radiation that is reflected towards the infrared sensor to sharply decrease, and the decrease in radiation reaching the infrared sensor is used as an indication that the bottle is nearly empty.

The arrangement disclosed in U.S. Pat. No. 9,027,788 has a number of disadvantages. For example, in order for the radiation to pass through the rear wall of the bottle and be reflected from the front wall of the bottle, the bottle needs to incorporate multiple different materials having different reflective properties. Furthermore, the arrangement and type of sensors and emitters may need to be modified for different types of fluids, depending on how the radiation interacts with each fluid. In addition, merely detecting whether the bottom of the collapsible bottle is above or below the infrared emitter provides relatively little information about the volume of fluid remaining in the bottle. For example, merely detecting whether the bottom of the bottle is above or below the infrared emitter would not distinguish between a full bottle and one that is half empty, if the bottom of the bottle remains below the infrared emitter in both circumstances.

SUMMARY OF THE INVENTION

To at least partially overcome some of the disadvantages of previously known methods and devices, the present invention provides a collapsible bottle, a fluid dispenser, and a method of using a sensor to measure a distance between the sensor and a preselected surface of the collapsible bottle. The inventors have appreciated that the distance between the sensor and the preselected surface can provide a useful indication of the volume of fluid remaining in the bottle, without requiring the bottle to incorporate a variety of different materials with different reflective properties, and without requiring radiation to be transmitted through the fluid. The method can advantageously be used with any type of fluid and any type of bottle, so long as the bottle collapses in a suitably predictable manner as the fluid is dispensed therefrom. The sensor can also be located at any suitable location relative to the bottle, and for example may be located on a housing of a fluid dispenser carrying the collapsible bottle.

Optionally, the sensor may be a time of flight sensor, which determines the distance between the sensor and the preselected surface by measuring the amount of time it takes for light emitted from the sensor to be reflected back to the sensor from the preselected surface. This can provide an accurate measurement of the distance between the sensor and the preselected surface, which can in turn be used to accurately determine the volume of fluid remaining in the bottle. This information may be used, for example, to provide an indication to users and/or maintenance staff as to the amount of fluid left in the bottle, to notify maintenance staff when the bottle needs to be replaced, or for any other suitable purpose, such as tracking the usage of hand cleaning fluid over time.

The preselected surface is preferably an outer surface of an exterior wall of the bottle that is designed to move away from the sensor in a predictable manner as the bottle collapses. For example, the preselected surface is optionally an outer surface of a first exterior wall that is thinner than one or more of the other exterior walls of the bottle, so that the first exterior wall more readily deforms inwardly, in comparison with the other exterior walls, under the vacuum pressure that is generated when the fluid is dispensed from the bottle. Optionally, the first exterior wall has a convex shape when the bottle is full, and inverts to adopt a concave shape when the bottle collapses. Furthermore, one of more of the other exterior walls may be provided with a reinforcement structure, such as a groove or a rib, which resists deformation. These and other features can preferably be used to cause the first exterior wall to move a relatively large distance in a predictable manner during the collapse of the bottle, with the result that the distance between the first exterior wall and the sensor can be used to determine the volume of fluid remaining in the bottle.

Optionally, the collapsible bottle may be produced by a blow molding process, including steps of forming a cylindrical preform having a preform wall that extends concentrically about an axis, and inflating the preform so that the preform wall expands to form the exterior walls of the collapsible bottle. During the inflating step, the thickness of the preform wall decreases as the preform wall expands radially outwardly from the axis. As a result, the thickness of the first exterior wall is dependent on the distance of the first exterior wall from the axis. Preferably, the first exterior wall is further from the axis than one or more of the other exterior walls, so that the first exterior wall is thinner, and thus more readily deformable, than the other exterior walls.

The method also preferably includes steps for establishing a correlation between the volume of fluid contained in the bottle and the distance between the sensor and the preselected surface. For example, preferably one or more test fluid dispensers are provided with a test sensor and a test collapsible bottle, the test fluid dispenser, the test sensor, and the test collapsible bottle being identical to corresponding production fluid dispensers, sensors, and collapsible bottles produced for use and/or for sale. The method preferably includes steps of measuring a volume of a test fluid contained in the test collapsible bottle at various stages of collapse, using the test sensor to measure the distance between the test sensor and the preselected surface of the test collapsible bottle at each of the various stages of collapse, and establishing a correlation between the volume of the test fluid contained in the test collapsible bottle and the distance between the test sensor and the preselected surface of the test collapsible bottle at the various stages of collapse. This correlation can then be used with the corresponding production fluid dispensers to determine the volume of fluid contained in the collapsible bottle based on the distance between the sensor and the preselected surface as measured by the sensor.

Optionally, a fluid dispenser in accordance with the invention can incorporate two or more sensors that measure the distance between the sensors and two or more preselected surfaces of the bottle. This may be useful for bottles in which there is some variability in the pattern of collapse, as having distance measurements for two or more surfaces may help to distinguish between different collapse patterns, and thus provide a more accurate assessment of the volume of fluid remaining in the bottle.

Accordingly, in a first aspect the present invention resides in a collapsible bottle defining a variable volume internal compartment for containing a fluid to be dispensed from a fluid dispenser, the collapsible bottle comprising:

a first exterior wall;

a second exterior wall;

a third exterior wall; and a neck that extends along an axis away from the third exterior wall, the neck having an opening in fluid communication with the internal compartment;

wherein the internal compartment contains an initial volume of the fluid when the collapsible bottle is in an initial configuration;

wherein, as the fluid is dispensed from the collapsible bottle, the collapsible bottle deforms from the initial configuration towards a collapsed configuration, the internal compartment containing a smaller volume of the fluid when in the collapsed configuration than when in the initial configuration;

wherein the first exterior wall is thinner than the second exterior wall;

wherein the first exterior wall is further from the axis than the second exterior wall is from the axis when the collapsible bottle is in the initial configuration; and wherein the first exterior wall moves towards the axis as the collapsible bottle deforms from the initial configuration towards the collapsed configuration.

In a second aspect, the present invention resides in a collapsible bottle, which optionally incorporates one or more features of the first aspect, wherein a vacuum is generated within the collapsible bottle when the fluid is dispensed from the collapsible bottle, the vacuum causing the collapsible bottle to collapse in a predictable manner.

In a third aspect, the present invention resides in a collapsible bottle, which optionally incorporates one or more features of one or more of the first and second aspects, wherein, as the collapsible bottle collapses, the first exterior wall moves towards the second exterior wall.

In a fourth aspect, the present invention resides in a collapsible bottle, which optionally incorporates one or more features of one or more of the first to third aspects, wherein the first exterior wall moves a greater distance towards the second exterior wall than the second exterior wall moves towards the first exterior wall as the collapsible bottle collapses.

In a fifth aspect, the present invention resides in a collapsible bottle, which optionally incorporates one or more features of one or more of the first to fourth aspects, wherein the first exterior wall has a convex shape when the collapsible bottle is in the initial configuration, and has a concave shape when the collapsible bottle is in the collapsed configuration.

In a sixth aspect, the present invention resides in a collapsible bottle, which optionally incorporates one or more features of one or more of the first to fifth aspects, wherein the first exterior wall and the second exterior wall are each intersected by a first plane that contains the axis;

wherein the collapsible bottle has a fourth exterior wall and a fifth exterior wall that are each intersected by a second plane that contains the axis, the second plane being perpendicular to the first plane;

wherein the collapsible bottle has a sixth exterior wall that is intersected by the axis; and wherein the fourth exterior wall, the fifth exterior wall, and the sixth exterior wall have a reinforcement structure that resists deformation of the fourth exterior wall, the fifth exterior wall, and the sixth exterior wall as the collapsible bottle deforms from the initial configuration towards the collapsed configuration.

In a seventh aspect, the present invention resides in a collapsible bottle, which optionally incorporates one or more features of one or more of the first to sixth aspects, wherein the reinforcement structure comprises a groove or a rib.

In an eighth aspect, the present invention resides in a collapsible bottle, which optionally incorporates one or more features of one or more of the first to seventh aspects, wherein the reinforcement structure comprises a groove that at least partially extends across the fourth exterior wall, the fifth exterior wall, and the sixth exterior wall; and wherein the groove is located where a third plane intersects the fourth exterior wall, the fifth exterior wall, and the sixth exterior wall, the third plane being parallel to the second plane.

In a ninth aspect, the present invention resides in a collapsible bottle, which optionally incorporates one or more features of one or more of the first to eighth aspects, wherein the collapsible bottle has a first connecting wall that extends between the fourth exterior wall and the first exterior wall; and a second connecting wall that extends between the fifth exterior wall and the first exterior wall;

wherein the collapsible bottle has a first edge portion where the first connecting wall meets the fourth exterior wall; a second edge portion where the first connecting wall meets the first exterior wall; a third edge portion where the fifth exterior wall meets the second connecting wall; a fourth edge portion where the second connecting wall meets the first exterior wall; a fifth edge portion where the first exterior wall meets the third exterior wall; and a sixth edge portion where the first exterior wall meets the sixth exterior wall;

wherein the collapsible bottle has a first corner portion where the second edge portion meets the first edge portion and the fifth edge portion; a second corner portion where the second edge portion meets the first edge portion and the sixth edge portion; a third corner portion where the fourth edge portion meets the third edge portion and the fifth edge portion; and a fourth corner portion where the fourth edge portion meets the third edge portion and the sixth edge portion;

wherein the second edge portion has a first intermediate portion that is spaced from the first edge portion and is located between the first corner portion and the second corner portion; wherein, when the collapsible bottle is in the initial configuration, the first intermediate portion is closer to the first plane than the first corner portion is to the first plane, and the first intermediate portion is further from the second plane than the first corner portion is from the second plane;

wherein the fourth edge portion has a second intermediate portion that is spaced from the third edge portion and is located between the third corner portion and the fourth corner portion; and wherein, when the collapsible bottle is in the initial configuration, the second intermediate portion is closer to the first plane than the third corner portion is to the first plane, and the second intermediate portion is further from the second plane than the third corner portion is from the second plane.

In a tenth aspect, the present invention resides in a collapsible bottle, which optionally incorporates one or more features of one or more of the first to ninth aspects, wherein the first connecting wall and the second connecting wall are substantially planar when the collapsible bottle is in the initial configuration.

In an eleventh aspect, the present invention resides in a collapsible bottle, which optionally incorporates one or more features of one or more of the first to tenth aspects, wherein, when the collapsible bottle is in the initial configuration, the first edge portion and the third edge portion are at least partially concave.

In a twelfth aspect, the present invention resides in a collapsible bottle, which optionally incorporates one or more features of one or more of the first to eleventh aspects, wherein, when the collapsible bottle is in the initial configuration, the fifth edge portion is at least partially concave.

In a thirteenth aspect, the present invention resides in a collapsible bottle, which optionally incorporates one or more features of one or more of the first to twelfth aspects, wherein, when the collapsible bottle is in the initial configuration, the fifth edge portion is closer to the axis than the sixth edge portion is to the axis.

In a fourteenth aspect, the present invention resides in a collapsible bottle, which optionally incorporates one or more features of one or more of the first to thirteenth aspects, wherein the first exterior wall is a rear wall of the collapsible bottle; the second exterior wall is a front wall of the collapsible bottle; the third exterior wall is a bottom wall of the collapsible bottle; the fourth exterior wall is a right side wall of the collapsible bottle; the fifth exterior wall is a left side wall of the collapsible bottle; and the sixth exterior wall is a top wall of the collapsible bottle.

In a fifteenth aspect, the present invention resides in a collapsible bottle, which optionally incorporates one or more features of one or more of the first to fourteenth aspects, wherein, during the collapse of the collapsible bottle from the initial configuration towards the collapsed configuration, the sixth edge portion moves axially downwardly towards the neck.

In a sixteenth aspect, the present invention resides in a collapsible bottle, which optionally incorporates one or more features of one or more of the first to fifteenth aspects, wherein the fluid is a hand cleaning fluid.

In a seventeenth aspect, the present invention resides in a method, which optionally incorporates one or more features of one or more of the first to sixteenth aspects, the method comprising:

providing a fluid dispenser, the fluid dispenser having a distance measuring sensor; providing a collapsible bottle, the collapsible bottle containing a fluid to be dispensed from the fluid dispenser;

coupling the collapsible bottle to the fluid dispenser so that a preselected surface of the collapsible bottle is positioned in a measurement path of the sensor;

activating the fluid dispenser to dispense an allotment of the fluid from the collapsible bottle, the collapsible bottle collapsing as the fluid is dispensed from the collapsible bottle;

using the sensor to measure a distance between the sensor and the preselected surface of the collapsible bottle, the distance changing as the collapsible bottle collapses; and determining a volume of the fluid contained in the collapsible bottle based on the distance between the sensor and the preselected surface of the collapsible bottle.

In an eighteenth aspect, the present invention resides in a method, which optionally incorporates one or more features of one or more of the first to seventeenth aspects, wherein the preselected surface is an outwardly facing surface of the collapsible bottle that moves away from the sensor as the collapsible bottle collapses.

In a nineteenth aspect, the present invention resides in a method, which optionally incorporates one or more features of one or more of the first to eighteenth aspects, wherein the sensor comprises a time of flight sensor.

In a twentieth aspect, the present invention resides in a method, which optionally incorporates one or more features of one or more of the first to nineteenth aspects, wherein the method further comprises at least one of:

displaying a visual indication of the volume of the fluid contained in the collapsible bottle; notifying maintenance staff when the volume of the fluid contained in the collapsible bottle falls below a preselected threshold; and storing or transmitting data representing the volume of the fluid contained in the collapsible bottle.

In a twenty first aspect, the present invention resides in a method, which optionally incorporates one or more features of one or more of the first to twentieth aspects, wherein dispensing the fluid from the collapsible bottle generates a vacuum within the collapsible bottle that causes the collapsible bottle to collapse in a predictable manner.

In a twenty second aspect, the present invention resides in a method, which optionally incorporates one or more features of one or more of the first to twenty first aspects, wherein the method further comprises:

determining whether the collapsible bottle has been correctly coupled to the fluid dispenser based on detection data from the sensor.

In a twenty third aspect, the present invention resides in a method, which optionally incorporates one or more features of one or more of the first to twenty second aspects, wherein the collapsible bottle has a first exterior wall and a second exterior wall; wherein the preselected surface is an outer surface of the first exterior wall; and wherein, as the collapsible bottle collapses, the first exterior wall moves towards the second exterior wall.

In a twenty fourth aspect, the present invention resides in a method, which optionally incorporates one or more features of one or more of the first to twenty third aspects, wherein the first exterior wall is thinner than the second exterior wall.

In a twenty fifth aspect, the present invention resides in a method, which optionally incorporates one or more features of one or more of the first to twenty fourth aspects, wherein the first exterior wall moves a greater distance towards the second exterior wall than the second exterior wall moves towards the first exterior wall as the collapsible bottle collapses.

In a twenty sixth aspect, the present invention resides in a method, which optionally incorporates one or more features of one or more of the first to twenty fifth aspects, wherein the collapsible bottle defines a variable volume internal compartment for containing the fluid;

wherein the internal compartment contains an initial volume of the fluid when the collapsible bottle is in an initial configuration; and wherein, as the fluid is dispensed from the collapsible bottle, the collapsible bottle deforms from the initial configuration towards a collapsed configuration, the internal compartment containing a smaller volume of the fluid when in the collapsed configuration than when in the initial configuration.

In a twenty seventh aspect, the present invention resides in a method, which optionally incorporates one or more features of one or more of the first to twenty sixth aspects, wherein the first exterior wall has a convex shape when the collapsible bottle is in the initial configuration, and has a concave shape when the collapsible bottle is in the collapsed configuration.

In a twenty eighth aspect, the present invention resides in a method, which optionally incorporates one or more features of one or more of the first to twenty seventh aspects, wherein the collapsible bottle has a third exterior wall and a neck that extends along an axis away from the third exterior wall, the neck having an opening in fluid communication with the internal compartment;

wherein the first exterior wall is further from the axis than the second exterior wall is from the axis when the collapsible bottle is in the initial configuration;

wherein the neck remains stationary relative to the sensor as the collapsible bottle deforms from the initial configuration towards the collapsed configuration; and wherein the first exterior wall moves towards the axis as the collapsible bottle deforms from the initial configuration towards the collapsed configuration.

In a twenty ninth aspect, the present invention resides in a method, which optionally incorporates one or more features of one or more of the first to twenty eighth aspects, wherein providing the collapsible bottle comprises forming the collapsible bottle by a blow molding process;

wherein the blow molding process comprises:

forming a cylindrical preform having a preform wall that extends concentrically about the axis; and inflating the preform so that the preform wall expands to form at least the first exterior wall and the second exterior wall;

wherein a thickness of the preform wall decreases as the preform wall expands radially outwardly from the axis, so that a thickness of the first exterior wall is dependent on a distance of the first exterior wall from the axis, and a thickness of the second exterior wall is dependent on a distance of the second exterior wall from the axis; and wherein the first exterior wall is thinner than the second exterior wall because the distance of the first exterior wall from the axis is greater than the distance of the second exterior wall from the axis.

In a thirtieth aspect, the present invention resides in a method, which optionally incorporates one or more features of one or more of the first to twenty ninth aspects, wherein the first exterior wall and the second exterior wall are each intersected by a first plane that contains the axis;

wherein the collapsible bottle has a fourth exterior wall and a fifth exterior wall that are each intersected by a second plane that contains the axis, the second plane being perpendicular to the first plane;

wherein the collapsible bottle has a sixth exterior wall that is intersected by the axis; and wherein the fourth exterior wall, the fifth exterior wall, and the sixth exterior wall have a reinforcement structure that resists deformation of the fourth exterior wall, the fifth exterior wall, and the sixth exterior wall as the collapsible bottle deforms from the initial configuration towards the collapsed configuration.

In a thirty first aspect, the present invention resides in a method, which optionally incorporates one or more features of one or more of the first to thirtieth aspects, wherein the reinforcement structure comprises a groove or a rib.

In a thirty second aspect, the present invention resides in a method, which optionally incorporates one or more features of one or more of the first to thirty first aspects, wherein the reinforcement structure comprises a groove that at least partially extends across the fourth exterior wall, the fifth exterior wall, and the sixth exterior wall; and wherein the groove is located where a third plane intersects the fourth exterior wall, the fifth exterior wall, and the sixth exterior wall, the third plane being parallel to the second plane.

In a thirty third aspect, the present invention resides in a method, which optionally incorporates one or more features of one or more of the first to thirty second aspects, wherein the collapsible bottle has a first connecting wall that extends between the fourth exterior wall and the first exterior wall; and a second connecting wall that extends between the fifth exterior wall and the first exterior wall;

wherein the collapsible bottle has a first edge portion where the first connecting wall meets the fourth exterior wall; a second edge portion where the first connecting wall meets the first exterior wall; a third edge portion where the fifth exterior wall meets the second connecting wall; a fourth edge portion where the second connecting wall meets the first exterior wall; a fifth edge portion where the first exterior wall meets the third exterior wall; and a sixth edge portion where the first exterior wall meets the sixth exterior wall;

wherein the collapsible bottle has a first corner portion where the second edge portion meets the first edge portion and the fifth edge portion; a second corner portion where the second edge portion meets the first edge portion and the sixth edge portion; a third corner portion where the fourth edge portion meets the third edge portion and the fifth edge portion; and a fourth corner portion where the fourth edge portion meets the third edge portion and the sixth edge portion;

wherein the second edge portion has a first intermediate portion that is spaced from the first edge portion and is located between the first corner portion and the second corner portion; wherein, when the collapsible bottle is in the initial configuration, the first intermediate portion is closer to the first plane than the first corner portion is to the first plane, and the first intermediate portion is further from the second plane than the first corner portion is from the second plane;

wherein the fourth edge portion has a second intermediate portion that is spaced from the third edge portion and is located between the third corner portion and the fourth corner portion; and wherein, when the collapsible bottle is in the initial configuration, the second intermediate portion is closer to the first plane than the third corner portion is to the first plane, and the second intermediate portion is further from the second plane than the third corner portion is from the second plane.

In a thirty fourth aspect, the present invention resides in a method, which optionally incorporates one or more features of one or more of the first to thirty third aspects, wherein the first connecting wall and the second connecting wall are substantially planar when the collapsible bottle is in the initial configuration.

In a thirty fifth aspect, the present invention resides in a method, which optionally incorporates one or more features of one or more of the first to thirty fourth aspects, wherein, when the collapsible bottle is in the initial configuration, the first edge portion and the third edge portion are preferably at least partially concave.

In a thirty sixth aspect, the present invention resides in a method, which optionally incorporates one or more features of one or more of the first to thirty fifth aspects, wherein, when the collapsible bottle is in the initial configuration, the fifth edge portion is at least partially concave.

In a thirty seventh aspect, the present invention resides in a method, which optionally incorporates one or more features of one or more of the first to thirty sixth aspects, wherein, when the collapsible bottle is in the initial configuration, the fifth edge portion is closer to the axis than the sixth edge portion is to the axis.

In a thirty eighth aspect, the present invention resides in a method, which optionally incorporates one or more features of one or more of the first to thirty seventh aspects, wherein the first exterior wall is a rear wall of the collapsible bottle; the second exterior wall is a front wall of the collapsible bottle; the third exterior wall is a bottom wall of the collapsible bottle; the fourth exterior wall is a right side wall of the collapsible bottle; the fifth exterior wall is a left side wall of the collapsible bottle; and the sixth exterior wall is a top wall of the collapsible bottle.

In a thirty ninth aspect, the present invention resides in a method, which optionally incorporates one or more features of one or more of the first to thirty eighth aspects, wherein the sensor is located on a back plate of the fluid dispenser, and faces horizontally forwardly towards the rear wall of the collapsible bottle when the collapsible bottle is coupled to the fluid dispenser.

In a fortieth aspect, the present invention resides in a method, which optionally incorporates one or more features of one or more of the first to thirty ninth aspects, wherein, during the collapse of the collapsible bottle from the initial configuration towards the collapsed configuration, the sixth edge portion moves axially downwardly towards the neck.

In a forty first aspect, the present invention resides in a method, which optionally incorporates one or more features of one or more of the first to fortieth aspects, wherein the fluid dispenser has a second distance measuring sensor;

wherein, when the collapsible bottle is coupled to the fluid dispenser, a second preselected surface of the collapsible bottle is positioned in a measurement path of the second sensor; the method further comprising:

using the second sensor to measure a distance between the second sensor and the second preselected surface of the collapsible bottle;

wherein the volume of the fluid contained in the collapsible bottle is determined based on the distance between the sensor and the preselected surface of the collapsible bottle, and the distance between the second sensor and the second preselected surface of the collapsible bottle.

In a forty second aspect, the present invention resides in a method, which optionally incorporates one or more features of one or more of the first to forty first aspects, wherein the fluid dispenser is a production fluid dispenser;

wherein the sensor is a production sensor; and wherein the collapsible bottle is a production collapsible bottle;

the method further comprising:

providing a test fluid dispenser, the test fluid dispenser having a distance measuring test sensor;

providing a test collapsible bottle, the test collapsible bottle containing a test fluid to be dispensed from the test fluid dispenser;

coupling the test collapsible bottle to the test fluid dispenser so that a preselected surface of the test collapsible bottle is positioned in a measurement path of the test sensor;

activating the test fluid dispenser to dispense an allotment of the test fluid from the test collapsible bottle, the test collapsible bottle collapsing as the test fluid is dispensed from the test collapsible bottle;

measuring a volume of the test fluid contained in the test collapsible bottle at various stages of collapse;

using the test sensor to measure a distance between the test sensor and the preselected surface of the test collapsible bottle at each of the various stages of collapse;

establishing a correlation between the volume of the test fluid contained in the test collapsible bottle and the distance between the test sensor and the preselected surface of the test collapsible bottle at the various stages of collapse; and using the correlation to determine the volume of the fluid contained in the production collapsible bottle based on the distance between the production sensor and the preselected surface of the production collapsible bottle.

In a forty third aspect, the present invention resides in a method, which optionally incorporates one or more features of one or more of the first to forty second aspects, wherein the fluid is a hand cleaning fluid.

In a forty fourth aspect, the present invention resides in a fluid dispenser, which optionally incorporates one or more features of one or more of the first to forty third aspects, the fluid dispenser comprising:

a collapsible bottle containing a fluid to be dispensed;

a fluid pump for dispensing the fluid from the collapsible bottle; and a distance measuring sensor arranged to detect a distance between the sensor and a preselected surface of the collapsible bottle;

wherein the collapsible bottle collapses as the fluid is dispensed from the collapsible bottle, and the distance between the sensor and the preselected surface of the collapsible bottle changes as the collapsible bottle collapses.

In a forty fifth aspect, the present invention resides in a fluid dispenser, which optionally incorporates one or more features of one or more of the first to forty fourth aspects, wherein a vacuum is generated within the collapsible bottle when the fluid is dispensed from the collapsible bottle, the vacuum causing the collapsible bottle to collapse in a predictable manner.

In a forty sixth aspect, the present invention resides in a fluid dispenser, which optionally incorporates one or more features of one or more of the first to forty fourth aspects, wherein the fluid dispenser further comprises a processor that determines a volume of the fluid contained in the collapsible bottle based on the distance between the sensor and the preselected surface of the collapsible bottle as measured by the sensor.

In a forty seventh aspect, the present invention resides in a fluid dispenser, which optionally incorporates one or more features of one or more of the first to forty sixth aspects, wherein the fluid dispenser further comprises at least one of:
a visual indicator that provides a visual indication of the volume of the fluid contained in the collapsible bottle;
a notification system that notifies maintenance staff when the volume of the fluid contained in the collapsible bottle falls below a preselected threshold;
a memory for storing data received from the sensor or the processor; and a transmitter for transmitting data received from the sensor or the processor.

In a forty eighth aspect, the present invention resides in a fluid dispenser, which optionally incorporates one or more features of one or more of the first to forty seventh aspects, wherein the preselected surface is an outwardly facing surface of the collapsible bottle that moves away from the sensor as the collapsible bottle collapses.

In a forty ninth aspect, the present invention resides in a fluid dispenser, which optionally incorporates one or more features of one or more of the first to forty eighth aspects, wherein the sensor comprises a time of flight sensor.

In a fiftieth aspect, the present invention resides in a fluid dispenser, which optionally incorporates one or more features of one or more of the first to forty ninth aspects, wherein the collapsible bottle has a first exterior wall and a second exterior wall; wherein the preselected surface is an outer surface of the first exterior wall; and wherein, as the collapsible bottle collapses, the first exterior wall moves towards the second exterior wall.

In a fifty first aspect, the present invention resides in a fluid dispenser, which optionally incorporates one or more features of one or more of the first to fiftieth aspects, wherein the first exterior wall is thinner than the second exterior wall.

In a fifty second aspect, the present invention resides in a fluid dispenser, which optionally incorporates one or more features of one or more of the first to fifty first aspects, wherein the first exterior wall moves a greater distance towards the second exterior wall than the second exterior wall moves towards the first exterior wall as the collapsible bottle collapses.

In a fifty third aspect, the present invention resides in a fluid dispenser, which optionally incorporates one or more features of one or more of the first to fifty second aspects, wherein the collapsible bottle defines a variable volume internal compartment for containing the fluid;
wherein the internal compartment contains an initial volume of the fluid when the collapsible bottle is in an initial configuration; and
wherein, as the fluid is dispensed from the collapsible bottle, the collapsible bottle deforms from the initial configuration towards a collapsed configuration, the internal compartment containing a smaller volume of the fluid when in the collapsed configuration than when in the initial configuration.

In a fifty fourth aspect, the present invention resides in a fluid dispenser, which optionally incorporates one or more features of one or more of the first to fifty third aspects, wherein the first exterior wall has a convex shape when the collapsible bottle is in the initial configuration, and has a concave shape when the collapsible bottle is in the collapsed configuration.

In a fifty fifth aspect, the present invention resides in a fluid dispenser, which optionally incorporates one or more features of one or more of the first to fifty fourth aspects, wherein the collapsible bottle has a third exterior wall and a neck that extends along an axis away from the third exterior wall, the neck having an opening in fluid communication with the internal compartment;
wherein the first exterior wall is further from the axis than the second exterior wall is from the axis when the collapsible bottle is in the initial configuration;
wherein the neck remains stationary relative to the sensor as the collapsible bottle deforms from the initial configuration towards the collapsed configuration; and
wherein the first exterior wall moves towards the axis as the collapsible bottle deforms from the initial configuration towards the collapsed configuration.

In a fifty sixth aspect, the present invention resides in a fluid dispenser, which optionally incorporates one or more features of one or more of the first to fifty fifth aspects, wherein the first exterior wall and the second exterior wall are each intersected by a first plane that contains the axis;
wherein the collapsible bottle has a fourth exterior wall and a fifth exterior wall that are each intersected by a second plane that contains the axis, the second plane being perpendicular to the first plane;
wherein the collapsible bottle has a sixth exterior wall that is intersected by the axis; and
wherein the fourth exterior wall, the fifth exterior wall, and the sixth exterior wall have a reinforcement structure that resists deformation of the fourth exterior wall, the fifth exterior wall, and the sixth exterior wall as the collapsible bottle deforms from the initial configuration towards the collapsed configuration.

In a fifty seventh aspect, the present invention resides in a fluid dispenser, which optionally incorporates one or more features of one or more of the first to fifty sixth aspects, wherein the reinforcement structure comprises a groove or a rib.

In a fifty eighth aspect, the present invention resides in a fluid dispenser, which optionally incorporates one or more features of one or more of the first to fifty seventh aspects, wherein the reinforcement structure comprises a groove that at least partially extends across the fourth exterior wall, the fifth exterior wall, and the sixth exterior wall; and wherein the groove is located where a third plane intersects the fourth exterior wall, the fifth exterior wall, and the sixth exterior wall, the third plane being parallel to the second plane.

In a fifty ninth aspect, the present invention resides in a fluid dispenser, which optionally incorporates one or more features of one or more of the first to fifty eighth aspects, wherein the collapsible bottle has a first connecting wall that extends between the fourth exterior wall and the first exterior wall; and a second connecting wall that extends between the fifth exterior wall and the first exterior wall;
wherein the collapsible bottle has a first edge portion where the first connecting wall meets the fourth exterior wall; a second edge portion where the first connecting wall meets the first exterior wall; a third edge portion where the fifth exterior wall meets the second connecting wall; a fourth edge portion where the second connecting wall meets the first exterior wall; a fifth edge portion where the first exterior wall meets the third exterior wall; and a sixth edge portion where the first exterior wall meets the sixth exterior wall;

wherein the collapsible bottle has a first corner portion where the second edge portion meets the first edge portion and the fifth edge portion; a second corner portion where the second edge portion meets the first edge portion and the sixth edge portion; a third corner portion where the fourth edge portion meets the third edge portion and the fifth edge portion; and a fourth corner portion where the fourth edge portion meets the third edge portion and the sixth edge portion;

wherein the second edge portion has a first intermediate portion that is spaced from the first edge portion and is located between the first corner portion and the second corner portion; wherein, when the collapsible bottle is in the initial configuration, the first intermediate portion is closer to the first plane than the first corner portion is to the first plane, and the first intermediate portion is further from the second plane than the first corner portion is from the second plane;

wherein the fourth edge portion has a second intermediate portion that is spaced from the third edge portion and is located between the third corner portion and the fourth corner portion; and wherein, when the collapsible bottle is in the initial configuration, the second intermediate portion is closer to the first plane than the third corner portion is to the first plane, and the second intermediate portion is further from the second plane than the third corner portion is from the second plane.

In a sixtieth aspect, the present invention resides in a fluid dispenser, which optionally incorporates one or more features of one or more of the first to fifty ninth aspects, wherein the first connecting wall and the second connecting wall are substantially planar when the collapsible bottle is in the initial configuration.

In a sixty first aspect, the present invention resides in a fluid dispenser, which optionally incorporates one or more features of one or more of the first to sixtieth aspects, wherein, when the collapsible bottle is in the initial configuration, the first edge portion and the third edge portion are at least partially concave.

In a sixty second aspect, the present invention resides in a fluid dispenser, which optionally incorporates one or more features of one or more of the first to sixty first aspects, wherein, when the collapsible bottle is in the initial configuration, the fifth edge portion is at least partially concave.

In a sixty third aspect, the present invention resides in a fluid dispenser, which optionally incorporates one or more features of one or more of the first to sixty second aspects, wherein, when the collapsible bottle is in the initial configuration, the fifth edge portion is closer to the axis than the sixth edge portion is to the axis.

In a sixty fourth aspect, the present invention resides in a fluid dispenser, which optionally incorporates one or more features of one or more of the first to sixty third aspects, wherein the first exterior wall is a rear wall of the collapsible bottle; the second exterior wall is a front wall of the collapsible bottle; the third exterior wall is a bottom wall of the collapsible bottle; the fourth exterior wall is a right side wall of the collapsible bottle; the fifth exterior wall is a left side wall of the collapsible bottle; and the sixth exterior wall is a top wall of the collapsible bottle.

In a sixty fifth aspect, the present invention resides in a fluid dispenser, which optionally incorporates one or more features of one or more of the first to sixty fourth aspects, wherein the sensor is located on a back plate of the fluid dispenser, and faces horizontally forwardly towards the rear wall of the collapsible bottle.

In a sixty sixth aspect, the present invention resides in a fluid dispenser, which optionally incorporates one or more features of one or more of the first to sixty fifth aspects, wherein during the collapse of the collapsible bottle from the initial configuration towards the collapsed configuration, the sixth edge portion moves axially downwardly towards the neck.

In a sixty seventh aspect, the present invention resides in a fluid dispenser, which optionally incorporates one or more features of one or more of the first to sixty sixth aspects, wherein the fluid dispenser further comprises a second distance measuring sensor that is arranged to detect a distance between the second sensor and a second preselected surface of the collapsible bottle;

wherein the distance between the second sensor and the second preselected surface of the collapsible bottle changes as the collapsible bottle collapses.

In a sixty eighth aspect, the present invention resides in a fluid dispenser, which optionally incorporates one or more features of one or more of the first to sixty seventh aspects, wherein the fluid is a hand cleaning fluid.

In a sixty ninth aspect, the present invention resides in a collapsible bottle, which optionally incorporates one or more features of one or more of the first to sixty eighth aspects, wherein the first exterior wall is a rear wall of the collapsible bottle; the second exterior wall is a front wall of the collapsible bottle; the third exterior wall is a bottom wall of the collapsible bottle; the fourth exterior wall is a right side wall of the collapsible bottle; the fifth exterior wall is a left side wall of the collapsible bottle; and the sixth exterior wall is a top wall of the collapsible bottle; and wherein, during the collapse of the collapsible bottle from the initial configuration towards the collapsed configuration, the sixth edge portion moves axially downwardly towards the neck.

In a seventieth aspect, the present invention resides in a collapsible bottle, which optionally incorporates one or more features of one or more of the first to sixty ninth aspects, wherein, as the collapsible bottle collapses, the first exterior wall moves towards the second exterior wall; wherein the first exterior wall moves a greater distance towards the second exterior wall than the second exterior wall moves towards the first exterior wall as the collapsible bottle collapses; and wherein the first exterior wall has a convex shape when the collapsible bottle is in the initial configuration, and has a concave shape when the collapsible bottle is in the collapsed configuration.

In a seventy first aspect, the present invention resides in a collapsible bottle, which optionally incorporates one or more features of one or more of the first to seventieth aspects, wherein the first exterior wall and the second exterior wall are each intersected by a first plane that contains the axis; wherein the collapsible bottle has a fourth exterior wall and a fifth exterior wall that are each intersected by a second plane that contains the axis, the second plane being perpendicular to the first plane; wherein the collapsible bottle has a sixth exterior wall that is intersected by the axis; wherein the fourth exterior wall, the fifth exterior wall, and the sixth exterior wall have a reinforcement structure that resists deformation of the fourth exterior wall, the fifth exterior wall, and the sixth exterior wall as the collapsible bottle deforms from the initial configuration towards the collapsed configuration; wherein the reinforcement structure comprises a groove that at least partially extends across the fourth exterior wall, the fifth exterior wall, and the sixth exterior wall; and wherein the groove is located where a third plane intersects the fourth exterior wall, the fifth exterior wall, and the sixth exterior wall, the third plane being parallel to the second plane.

In a seventy second aspect, the present invention resides in a collapsible bottle, which optionally incorporates one or more features of one or more of the first to seventy first aspects, wherein the collapsible bottle has a first connecting wall that extends between the fourth exterior wall and the first exterior wall; and a second connecting wall that extends between the fifth exterior wall and the first exterior wall; wherein the collapsible bottle has a first edge portion where the first connecting wall meets the fourth exterior wall; a second edge portion where the first connecting wall meets the first exterior wall; a third edge portion where the fifth exterior wall meets the second connecting wall; a fourth edge portion where the second connecting wall meets the first exterior wall; a fifth edge portion where the first exterior wall meets the third exterior wall; and a sixth edge portion where the first exterior wall meets the sixth exterior wall; wherein the collapsible bottle has a first corner portion where the second edge portion meets the first edge portion and the fifth edge portion; a second corner portion where the second edge portion meets the first edge portion and the sixth edge portion; a third corner portion where the fourth edge portion meets the third edge portion and the fifth edge portion; and a fourth corner portion where the fourth edge portion meets the third edge portion and the sixth edge portion; wherein the second edge portion has a first intermediate portion that is spaced from the first edge portion and is located between the first corner portion and the second corner portion; wherein, when the collapsible bottle is in the initial configuration, the first intermediate portion is closer to the first plane than the first corner portion is to the first plane, and the first intermediate portion is further from the second plane than the first corner portion is from the second plane; wherein the fourth edge portion has a second intermediate portion that is spaced from the third edge portion and is located between the third corner portion and the fourth corner portion; wherein, when the collapsible bottle is in the initial configuration, the second intermediate portion is closer to the first plane than the third corner portion is to the first plane, and the second intermediate portion is further from the second plane than the third corner portion is from the second plane; wherein the first connecting wall and the second connecting wall are substantially planar when the collapsible bottle is in the initial configuration; wherein, when the collapsible bottle is in the initial configuration, the first edge portion and the third edge portion are at least partially concave; wherein, when the collapsible bottle is in the initial configuration, the fifth edge portion is at least partially concave; and wherein, when the collapsible bottle is in the initial configuration, the fifth edge portion is closer to the axis than the sixth edge portion is to the axis.

In a seventy third aspect, the present invention resides in a collapsible bottle, which optionally incorporates one or more features of one or more of the first to seventy second aspects, wherein the first exterior wall is a rear wall of the collapsible bottle; the second exterior wall is a front wall of the collapsible bottle; the third exterior wall is a bottom wall of the collapsible bottle; the fourth exterior wall is a right side wall of the collapsible bottle; the fifth exterior wall is a left side wall of the collapsible bottle; and the sixth exterior wall is a top wall of the collapsible bottle; wherein, during the collapse of the collapsible bottle from the initial configuration towards the collapsed configuration, the sixth edge portion moves axially downwardly towards the neck; and wherein the fluid is a hand cleaning fluid.

BRIEF DESCRIPTION OF THE DRAWINGS

Further aspects and advantages of the invention will appear from the following description taken together with the accompanying drawings, which are in a computer generated format often known as wire-frame images with hidden-line removal, in which, simplistically stated, lines are shown where there is a change in the plane of a surface, and in which.

DETAILED DESCRIPTION OF THE DRAWINGS

Figure 1:
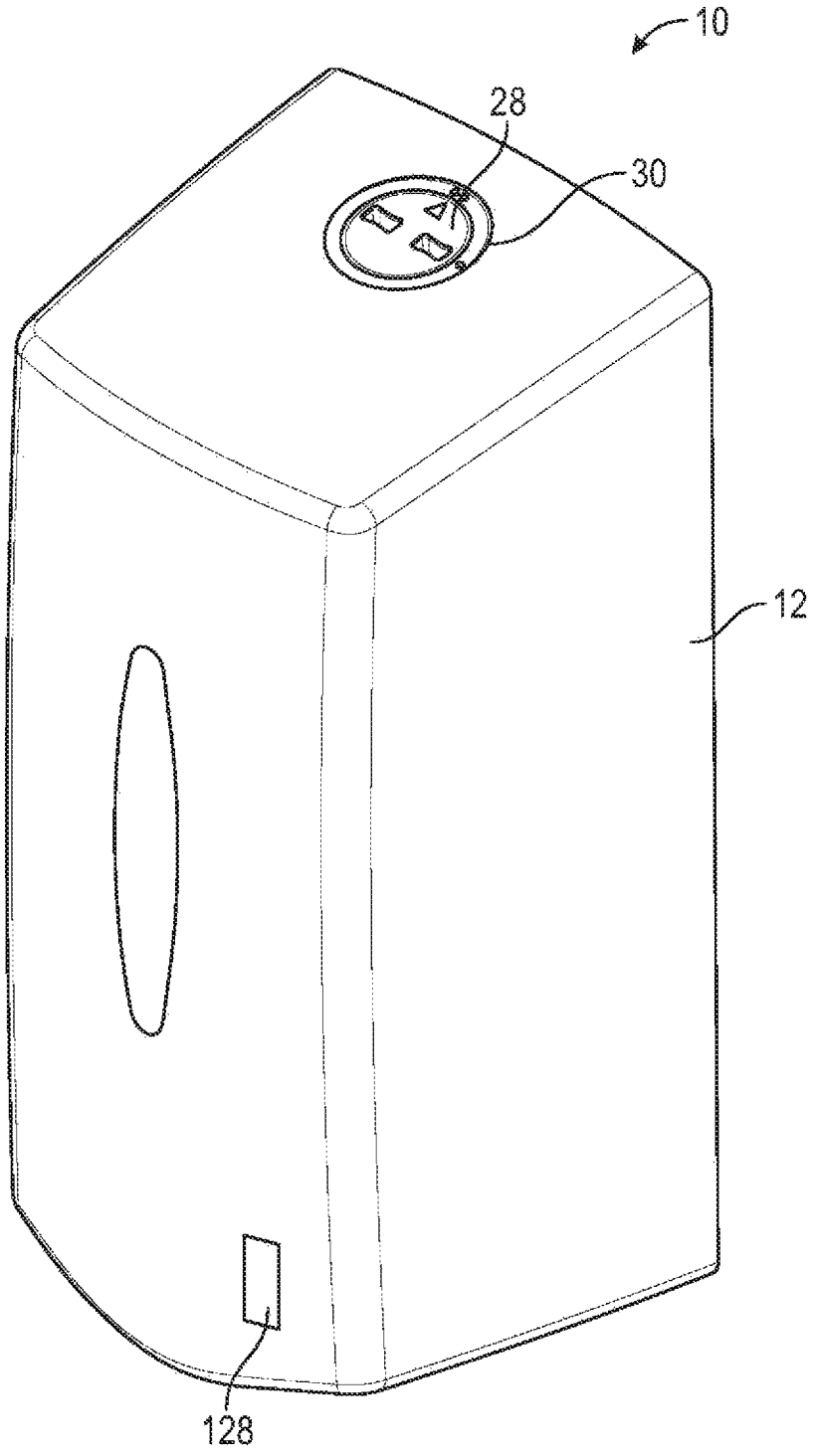
FIG. 1 is a perspective view of a fluid dispenser in accordance with a first embodiment of the present invention.
Figure 2:
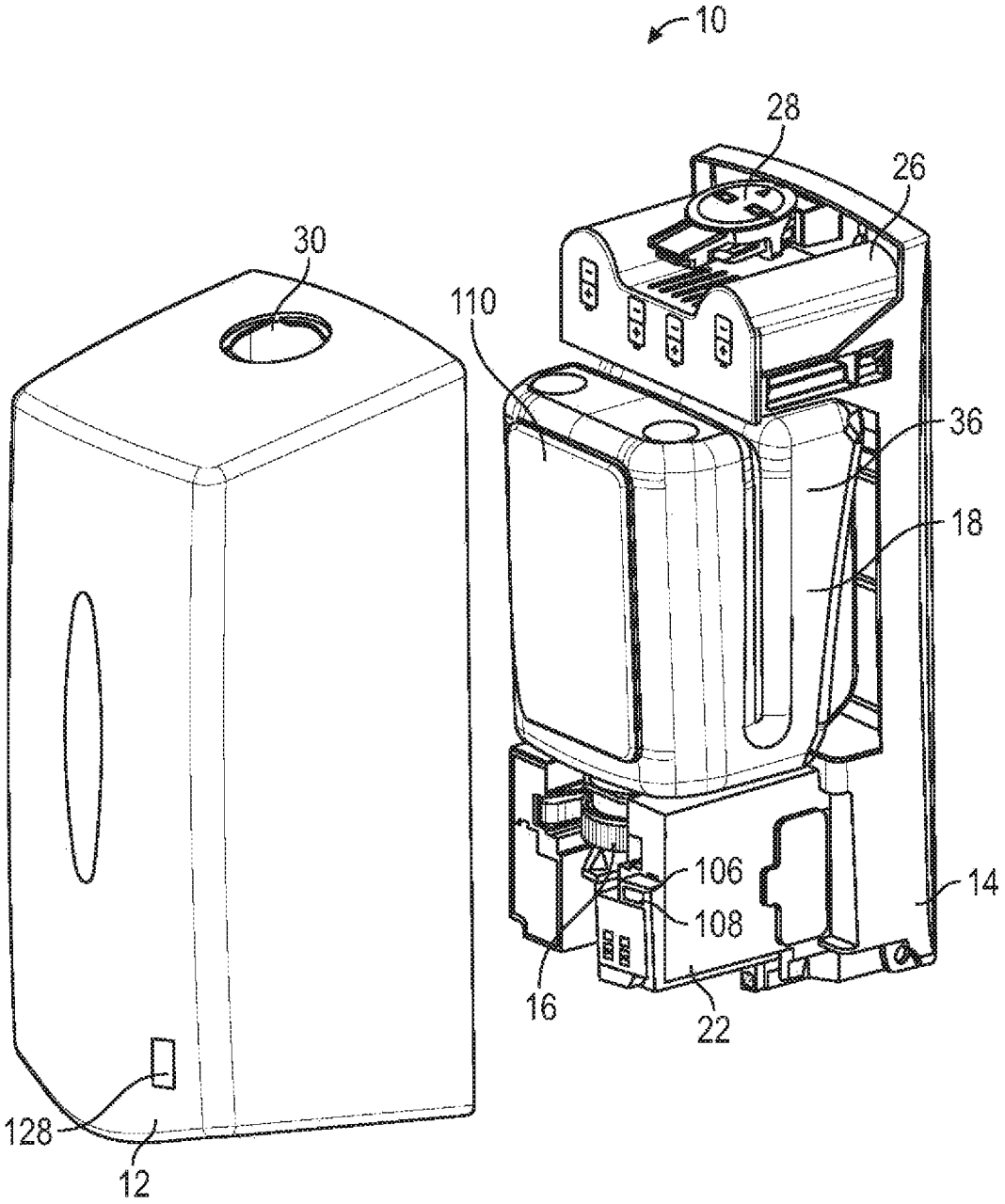
FIG. 2 is a perspective view the fluid dispenser of FIG. 1, with a cover of the fluid dispenser removed to show a housing, a fluid pump, and a fluid reservoir of the fluid dispenser.

FIGS. 1 and 2 show a fluid dispenser 10 in accordance with a first embodiment of the present invention. The fluid dispenser 10 has a removable cover 12, a housing 14, a fluid pump 16, and a fluid reservoir 18. The fluid pump 16 and the fluid reservoir 18 together form a replaceable cartridge 110.

Figure 3:
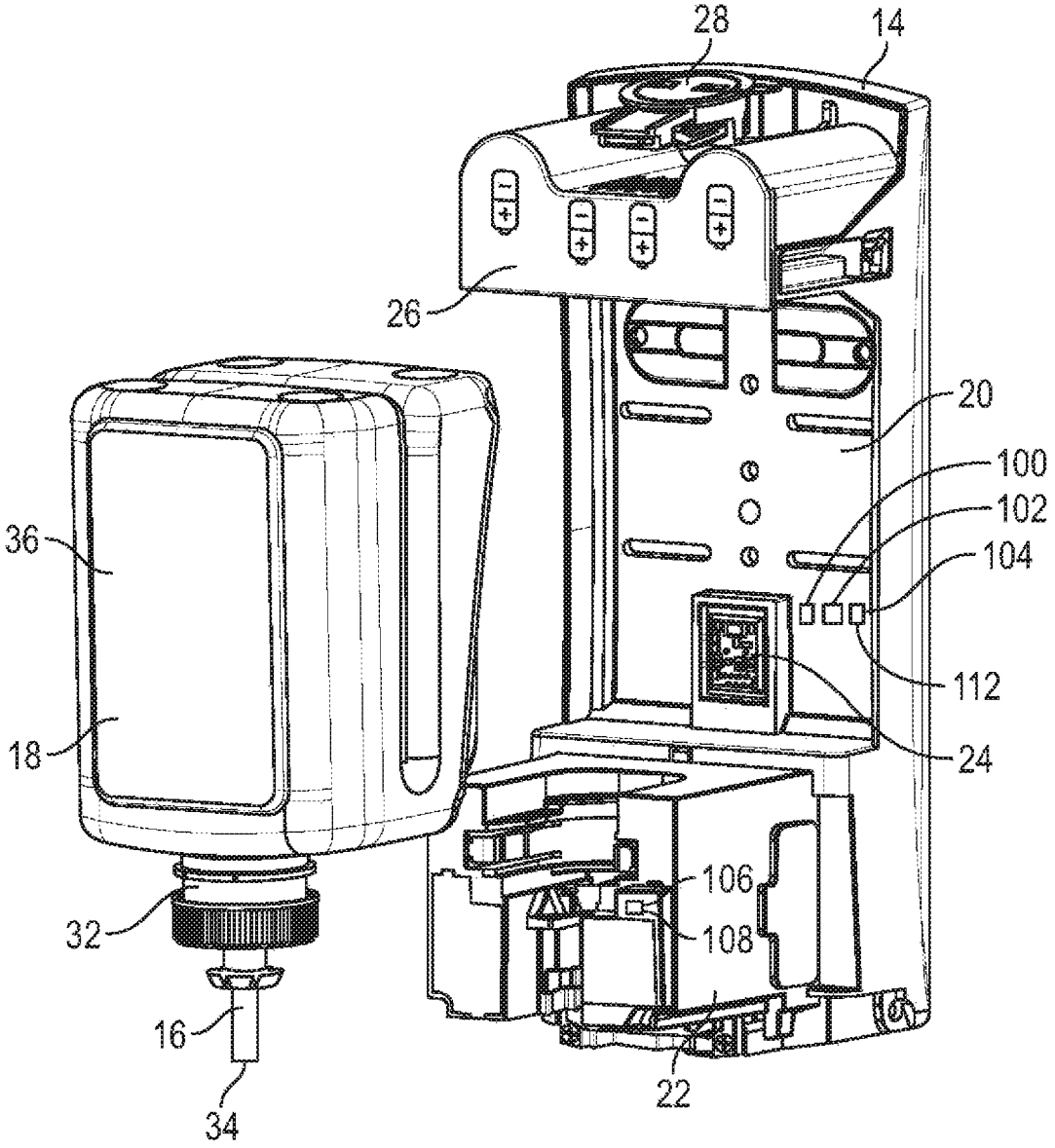
FIG. 3 is a perspective view of the housing, the fluid pump, and the fluid reservoir of FIG. 2, with the fluid pump and the fluid reservoir removed from the housing, and a sensor shown mounted on a back plate of the housing.

As best shown in FIG. 3, the housing 14 has a back plate 20 that is adapted to be mounted vertically to a wall or other vertical support structure. A pump engagement body 22 extends forwardly from the back plate 20 at the bottom of the housing 14. The pump engagement body 22 is configured to removably receive and support the replaceable cartridge 110 in a manner known in the art. The pump engagement body 22 may have any suitable structure, including for example those disclosed in U.S. Pat. No. 9,682,390 to Ophardt et al., issued Jun. 20, 2017; U.S. Pat. No. 8,113,388 to Ophardt et al., issued Feb. 14, 2012; and U.S. Pat. No. 5,373,970 to Ophardt, issued Dec. 20, 1994, which are each incorporated herein by reference.

As seen in FIG. 3, a time of flight sensor 24 is mounted on the back plate 20 above the pump engagement body 22. The sensor 24 is configured to emit a pulse of light horizontally forwardly towards a surface placed in front of the sensor 24, and to detect when the pulse of light is reflected back to the sensor 24 from the surface. The sensor 24 is able to accurately determine the distance between the sensor 24 and the surface based on the time it takes for the pulse of light to be reflected back to the sensor 24 from the surface. Time of flight sensors 24 are known in the art and are described, for example, in U.S. Pat. No. 10,278,550 to Ophardt et al., issued May 7, 2019, which is incorporated herein by reference.

A processor 100, a memory 102, and a wireless transmitter 104 are also mounted on the back plate 20 adjacent to the sensor 24. The processor 100 is configured to process measurement data received from the sensor 24, the memory 102 is configured to store the measurement data and other information received from the processor 100, and the wireless transmitter 104 is configured to wirelessly transmit the measurement data and other information received from the processor 100. A visual indicator 106 in the form of an LED light 108 is positioned on the pump engagement body 22. The LED light 108 is configured to turn on or off in response to instructions received from the processor 100. The processor 100, memory 102, wireless transmitter 104, and visual indicator 106 could be positioned at any suitable location or locations, and are not limited to those shown in the drawings. One or more of the processor 100, memory 102, wireless transmitter 104, and visual indicator 106 could also be omitted in some embodiments of the invention.

A battery holder 26 extends forwardly from the back plate 20 at the top of the housing 14. The battery holder 26 is configured to receive batteries for powering various electronic components of the dispenser 10, including the time of flight sensor 24. A cover locking mechanism 28 is positioned above the battery holder 26. The cover locking mechanism 28 engages with a top opening 30 of the cover 12 to hold the cover 12 in place over the housing 14, as shown in FIG. 1. The cover locking mechanism 28 can be manipulated by a suitable tool, not shown, to remove the cover 12 and gain access to the housing 14 so that, for example, the replaceable cartridge 110 can be removed and replaced. The locking mechanism 28 has two positions that are indicated by one dot and two dots, respectively, around the perimeter of the top opening 30. In a first position, when the triangular marker is pointed towards the one dot, the mechanism 28 acts as a latch and has no locking functionality. Upon turning the external button of the locking mechanism 28 ninety degrees counterclockwise by use of a key, so that the triangular marker is pointed towards the two dots, the mechanism 28 is put in a locked state. The cover 12 has a transparent window 128 that is aligned with the LED light 108 on the housing 14, so that the LED light 108 is visible to a user standing in front of the dispenser 10 when the cover 12 is attached to the housing 14. Alternatively, the transparent window 128 could be omitted and the LED light 108 could be seen through, for example, a thinned section of the cover 12 in opaque plastic, or the LED light 108 could be positioned at another location on the dispenser 10 where it is not hidden behind the cover 12.

The fluid pump 16 is configured to dispense fluid from the fluid reservoir 18 out of a fluid outlet 34 of the fluid pump 16. As best shown in FIG. 3, the fluid pump 16 threadedly engages with a neck 32 of the fluid reservoir 18. The fluid pump 16 may have any suitable construction, including for example those disclosed in U.S. Pat. No. 9,682,390 to Ophardt et al., issued Jun. 20, 2017; U.S. Pat. No. 8,113,388 to Ophardt et al., issued Feb. 14, 2012; and U.S. Pat. No. 5,373,970 to Ophardt, issued Dec. 20, 1994, which are each incorporated herein by reference. As is known in the art, the fluid pump 16 is unvented and generates a vacuum within the fluid reservoir 18 when the fluid is dispensed from the fluid reservoir 18. Fluid pumps 16 that generate a vacuum are described, for example, in U.S. Pat. No. 7,530,475 to Ophardt, issued May 12, 2009; and United States Patent Application Publication No. 2014/0217117 to Mirbach, published Aug. 7, 2014, each of which is incorporated herein by reference. The fluid pump 16 is preferably associated with a proximity sensor, not shown, which detects when a user's hand is placed below the fluid outlet 34. A motor, not shown, automatically activates the fluid pump 16 to dispense an allotment of fluid from the fluid reservoir 18 when the user's hand is detected below the fluid outlet 34. The use of a proximity sensor and a motor to automatically activate a fluid pump 16 is described, for example, in U.S. Pat. No. 5,836,482 to Ophardt et al., issued Nov. 17, 1998, which is incorporated herein by reference. Any other suitable mechanism for automatically or manually activating the fluid pump 16 could also be used.

The fluid reservoir 18 is best shown in FIGS. 4 to 20 as being a collapsible bottle 36 for containing a hand cleaning fluid to be dispensed from the fluid dispenser 10. The neck 32 of the bottle 36 is threaded for engagement with the fluid pump 16, and extends concentrically about an axis 38. As shown in FIG. 20, the neck 32 defines an opening 40 that is in fluid communication with a variable volume internal compartment 98 of the bottle 36 for delivering the fluid from the internal compartment 98 to the fluid pump 16.

Figure 4:
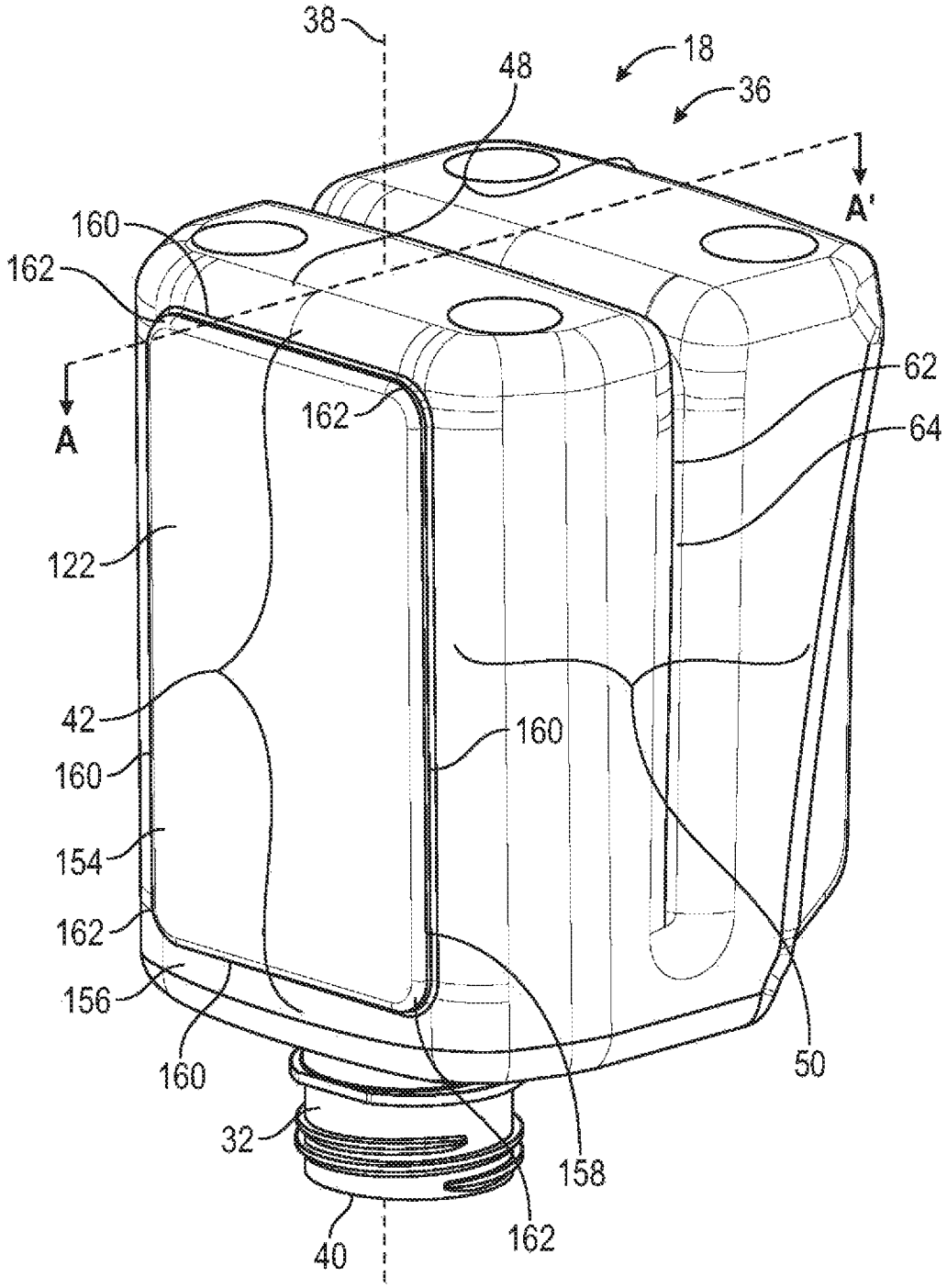
FIG. 4 is a perspective view of the fluid reservoir of FIG. 3, showing the front, top, and right side of the fluid reservoir.
Figure 5:
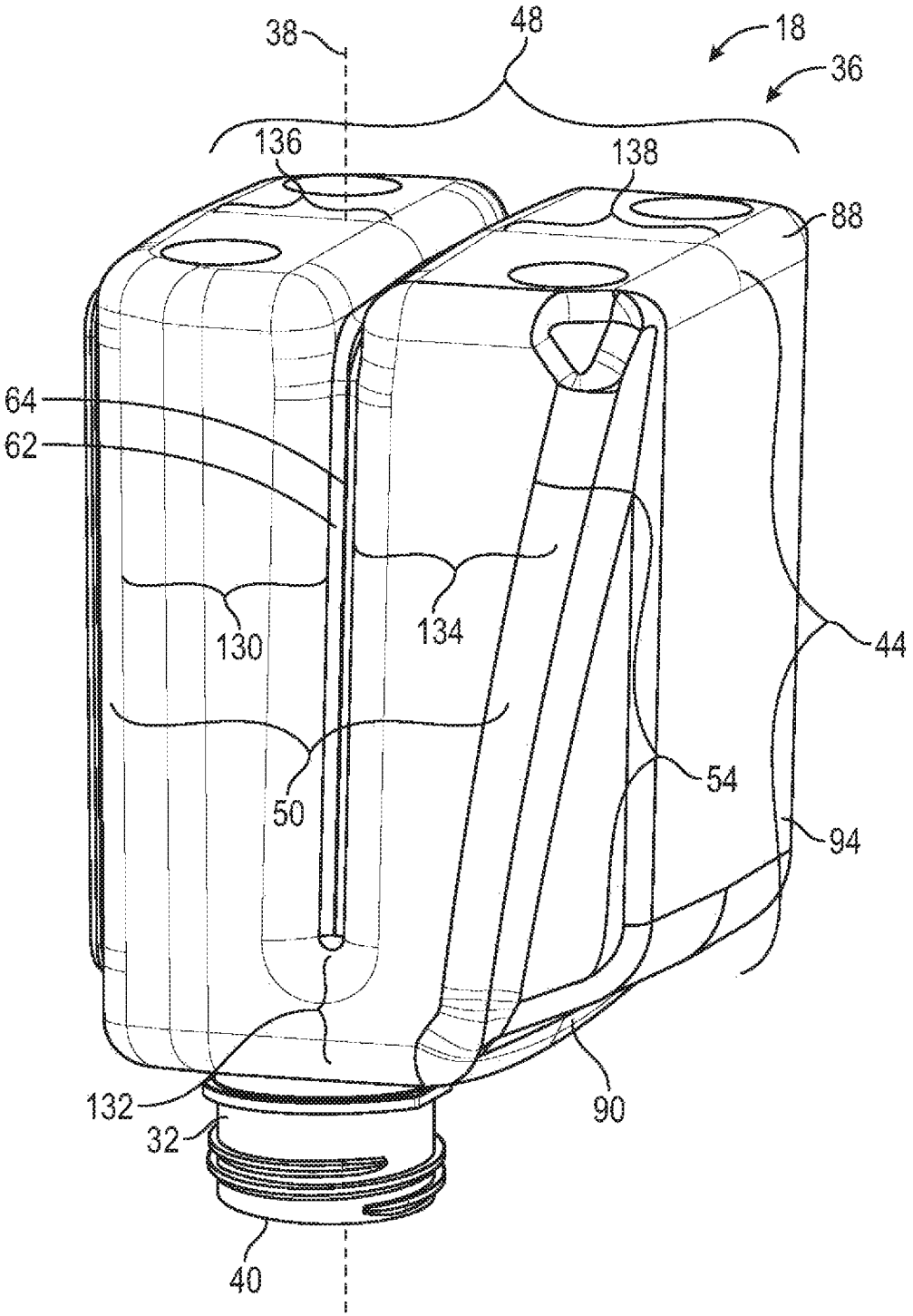
FIG. 5 is a perspective view of the fluid reservoir of FIG. 4, showing the rear, top, and right side of the fluid reservoir.
Figure 7:
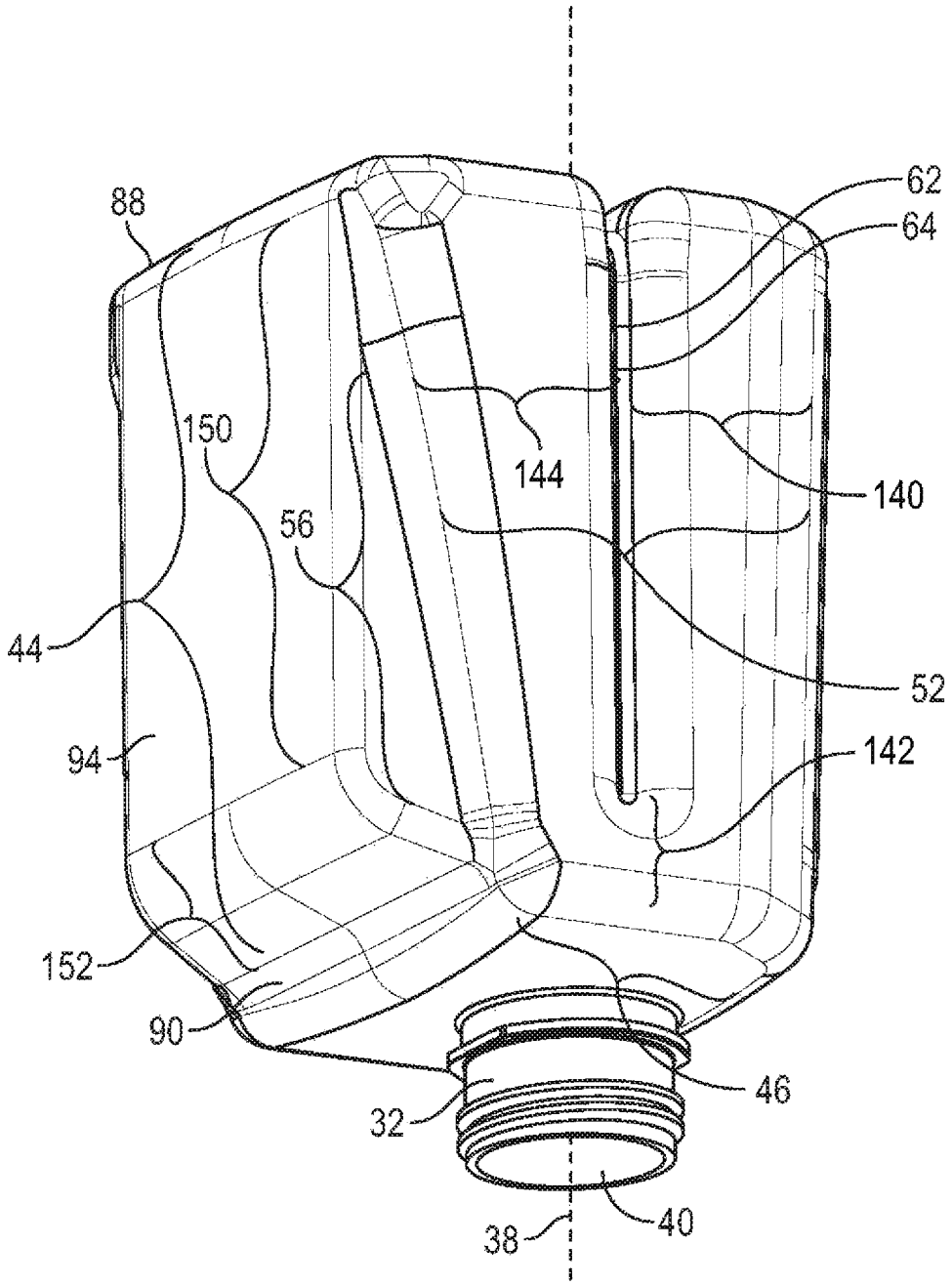
FIG. 7 is a perspective view of the fluid reservoir of FIG. 4, showing the rear, bottom, and left side of the fluid reservoir.

The collapsible bottle 36 has a front wall 42, a rear wall 44, a bottom wall 46, a top wall 48, a right side wall 50, and a left side wall 52, as best shown in FIGS. 4, 5, and 7. The right side wall 50 is connected to the rear wall 44 by a first connecting wall 54, as best shown in FIG. 5, and the left side wall 52 is connected to the rear wall 44 by a second connecting wall 56, as best shown in FIG. 7. The rear wall 44 is also referred to herein as the first exterior wall 44, the front wall 42 is also referred to as the second exterior wall 42, the bottom wall 46 is also referred to as the third exterior wall 46, the right side wall 50 is also referred to as the fourth exterior wall 50, the left side wall 52 is also referred to as the fifth exterior wall 52, and the top wall 48 is also referred to as the sixth exterior wall 48.

Figure 19:
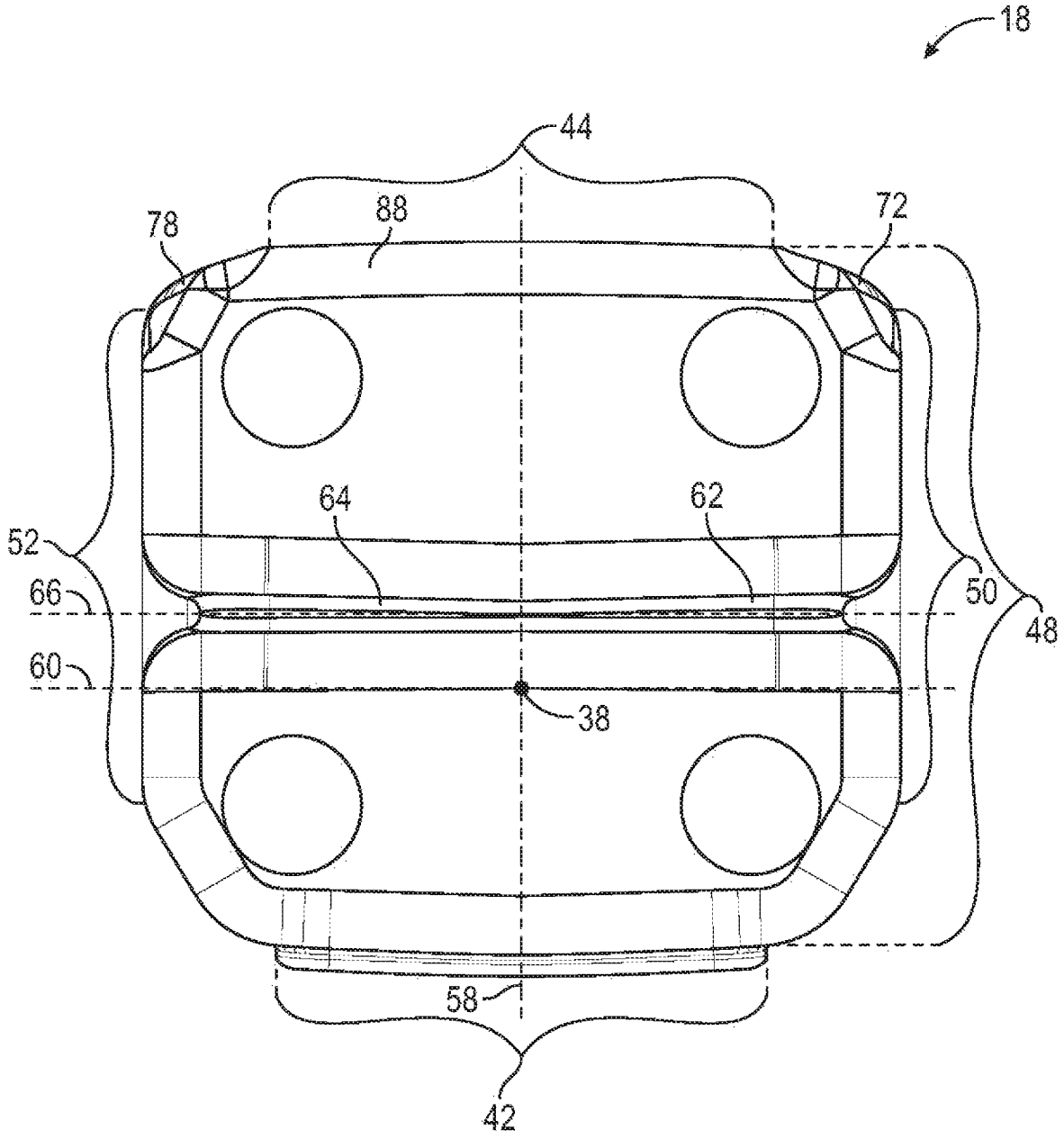
FIG. 19 is a top view of the fluid reservoir of FIG. 4.
Figure 20:
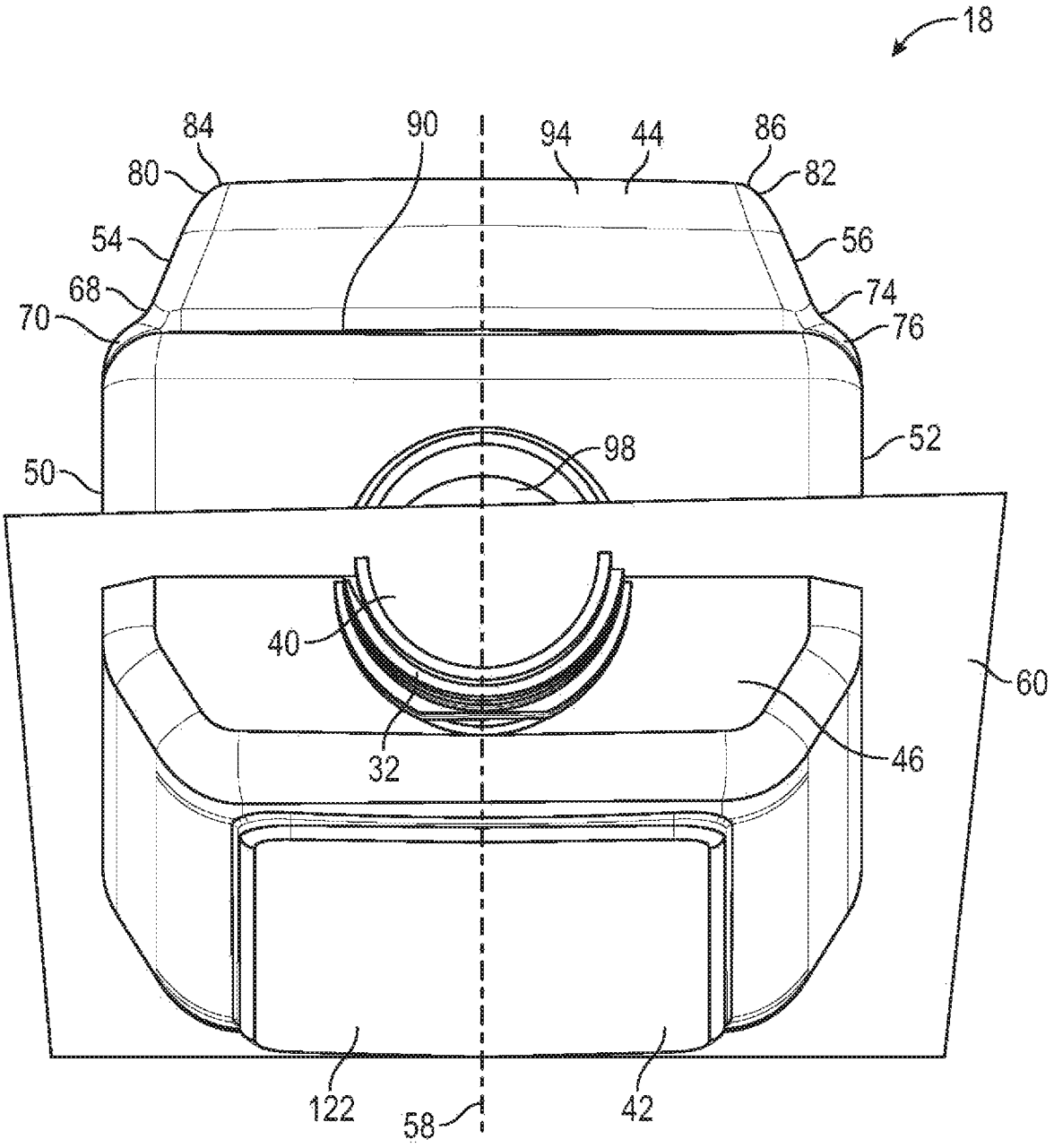
FIG. 20 is a bottom perspective view of the fluid reservoir of FIG. 4.

As shown in FIG. 19, the front wall 42, the rear wall 44, and the top wall 48 are intersected by a first plane 58 that contains the axis 38, and the right side wall 50, the left side wall 52, and the top wall 48 are intersected by a second plane 60 that contains the axis 38 and is perpendicular to the first plane 58. The front wall 42, the rear wall 44, the right side wall 50, and the left side wall 52 are each spaced from the axis 38, with the rear wall 44 being spaced further from the axis 38 than the front wall 42, the right side wall 50, and the left side wall 52. The axis 38 intersects the top wall 48, as shown in FIG. 19, and passes through the opening 40 of the neck 32, as shown in FIG. 7, the neck 32 extending axially away from the bottom wall 46. The bottle 36 is preferably symmetrical about the first plane 58. When viewed from the top, as shown in FIG. 19, the bottle 36 has a substantially square shape, which allows the bottle 36 to fit within the substantially square cavity that is defined between the housing 14 and the cover 12.

As can be seen in FIG. 4, the front wall 42 has a central panel 154 with a rounded rectangular perimeter 158. At the perimeter 158 of the central panel 154, the central panel 154 extends a short distance forwardly from a surrounding base portion 156 of the front wall 42. The perimeter 158 has four linear portions 160 and four rounded corner portions 162. The central panel 154, and in particular the curved and rounded portions of the perimeter 158 of the central panel 154, help to reinforce the front wall 42 and resist deformation of the front wall 42 when the bottle 36 collapses.

As can be seen in FIGS. 4 to 8, a groove 62 extends from near the bottom of the right side wall 50 up to the top wall 48, across the top wall 48 from the right side wall 50 to the left side wall 52, and down from the top wall 48 to near the bottom of the left side wall 52. The groove 62 extends inwardly from the exterior surface of the right side wall 50, the top wall 48, and the left side wall 52. As shown in FIG. 5, the groove 62 divides the right side wall 50 into a front right side portion 130 that is positioned in front of the groove 62, a bottom right side portion 132 that is positioned below the groove 62, and a rear right side portion 134 that is positioned behind the groove 62. As also shown in FIG. 5, the groove 62 divides the top wall 48 into a front top portion 136 that is positioned in front of the groove 62, and a rear top portion 138 that is positioned behind the groove 62. As shown in FIG. 7, the groove 62 also divides the left side wall 52 into a front left side portion 140 that is positioned in front of the groove 62, a bottom left side portion 142 that is positioned below the groove 62, and a rear left side portion 144 that is positioned behind the groove 62. The groove 62 acts as a reinforcement structure 64 that resists deformation of the right side wall 50, the left side wall 52, and the top wall 48. As can be seen in FIG. 19, the groove 62 is located where a third plane 66 intersects the right side wall 50, the top wall 48, and the left side wall 52, the third plane 66 being parallel to the second plane 60 and spaced towards the rear wall 44 from the axis 38.

Figure 6:
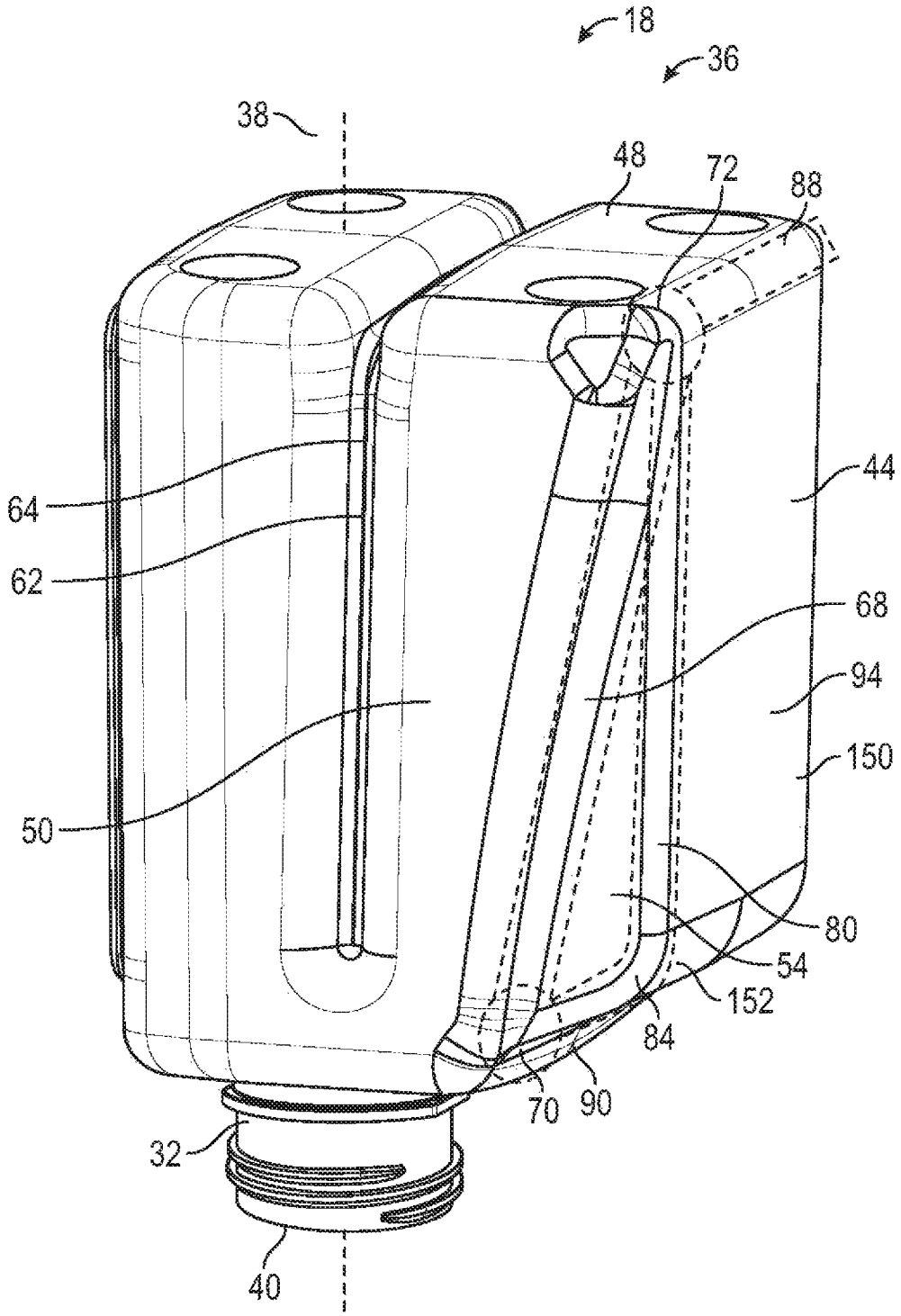
FIG. 6 is a perspective view of the fluid reservoir of FIG. 4, showing the rear, top, and right side of the fluid reservoir.

As shown in dotted lines in FIG. 6, the right side wall 50 has a right side edge portion 68 where the right side wall 50 meets the first connecting wall 54. The right side edge portion 68 extends from a bottom right corner 70 to a top right corner 72 of the bottle 36. The bottom right corner 70 is closer to the axis 38 than the top right corner 72 is to the axis 38, and so the right side edge portion 68 is slanted relative to the axis 38, with the right side edge portion 68 extending laterally away from the axis 38 as the right side edge portion 68 extends axially upwardly from the bottom right corner 70 to the top right corner 72.

Figure 8:
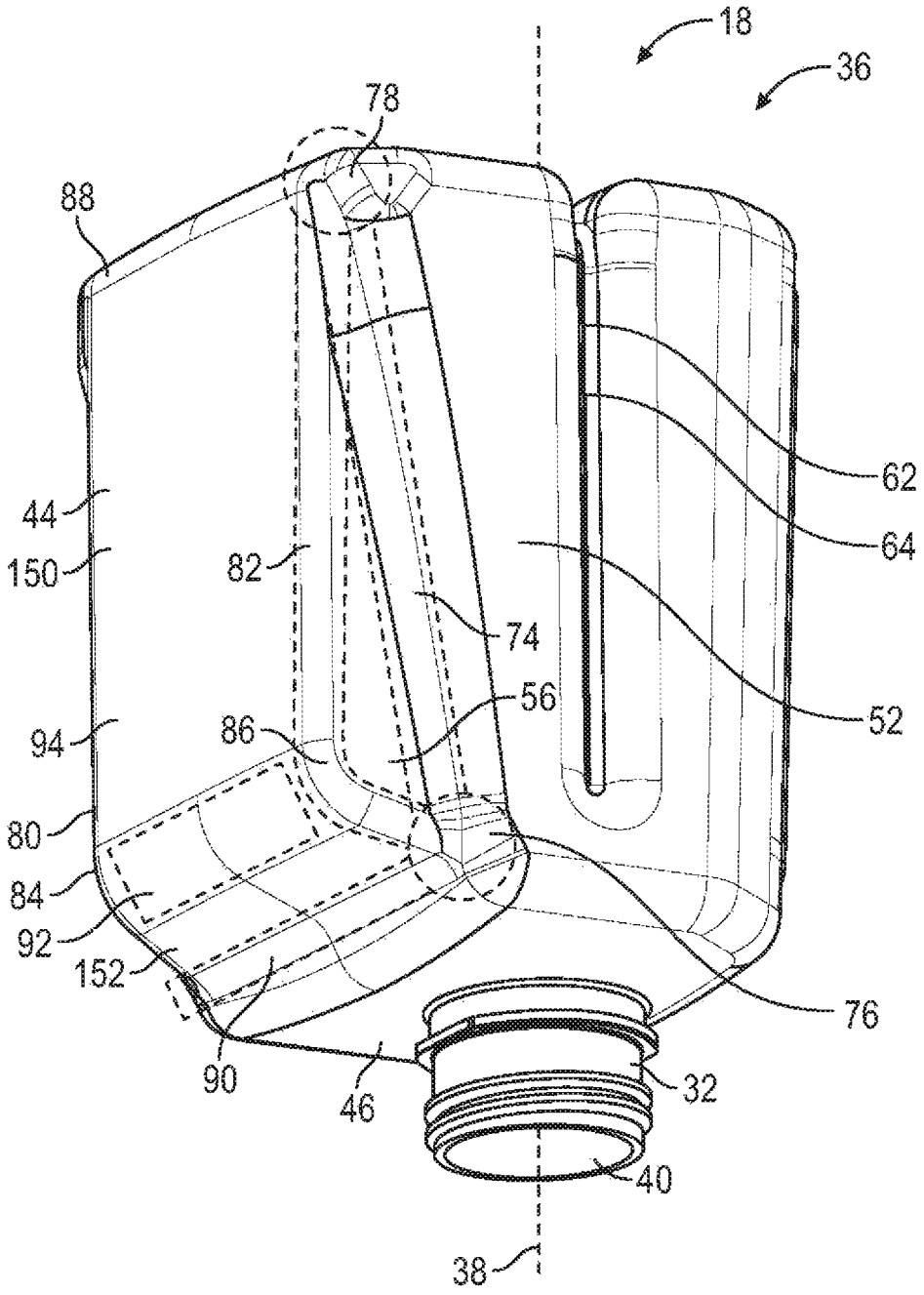
FIG. 8 is a perspective view of the fluid reservoir of FIG. 4, showing the rear, bottom, and left side of the fluid reservoir.
Figure 9:
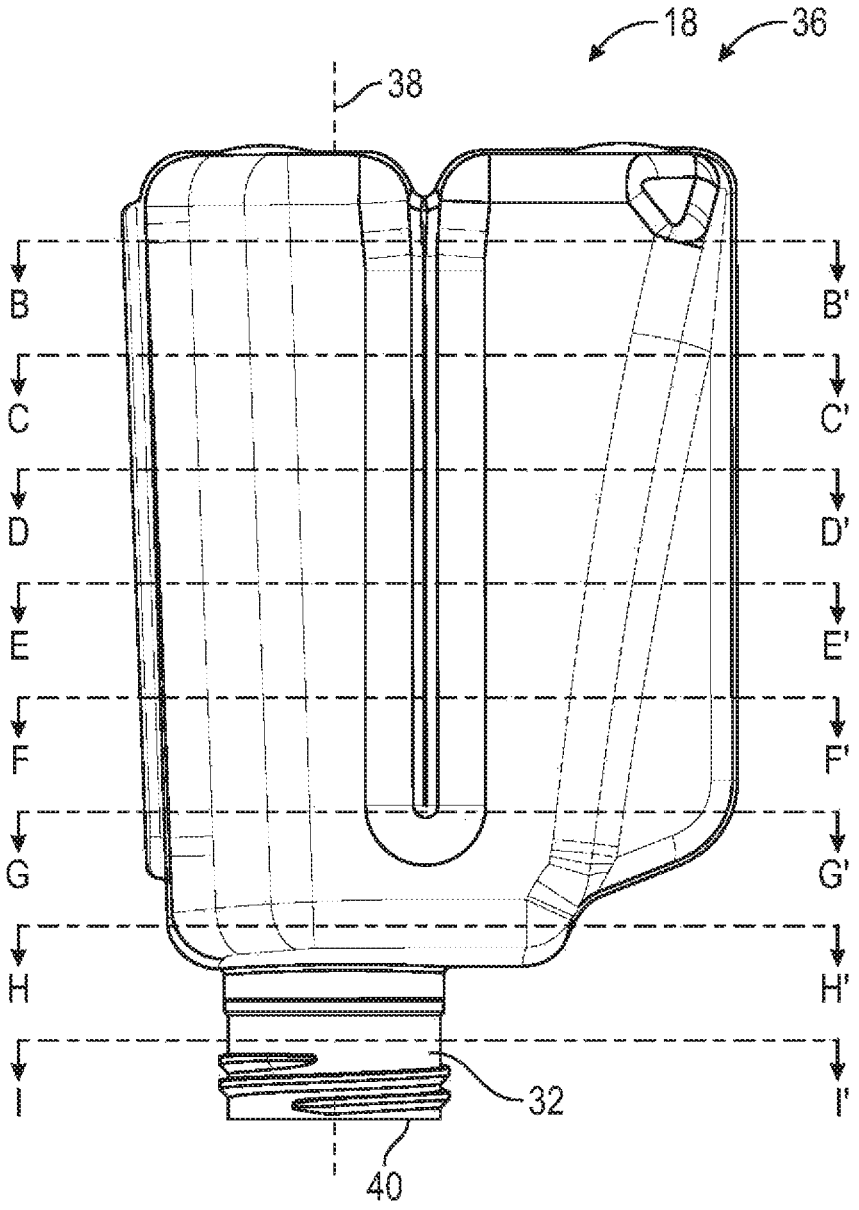
FIG. 9 is a side view of the fluid reservoir of FIG. 4, showing the right side of the fluid reservoir.
Figure 10:
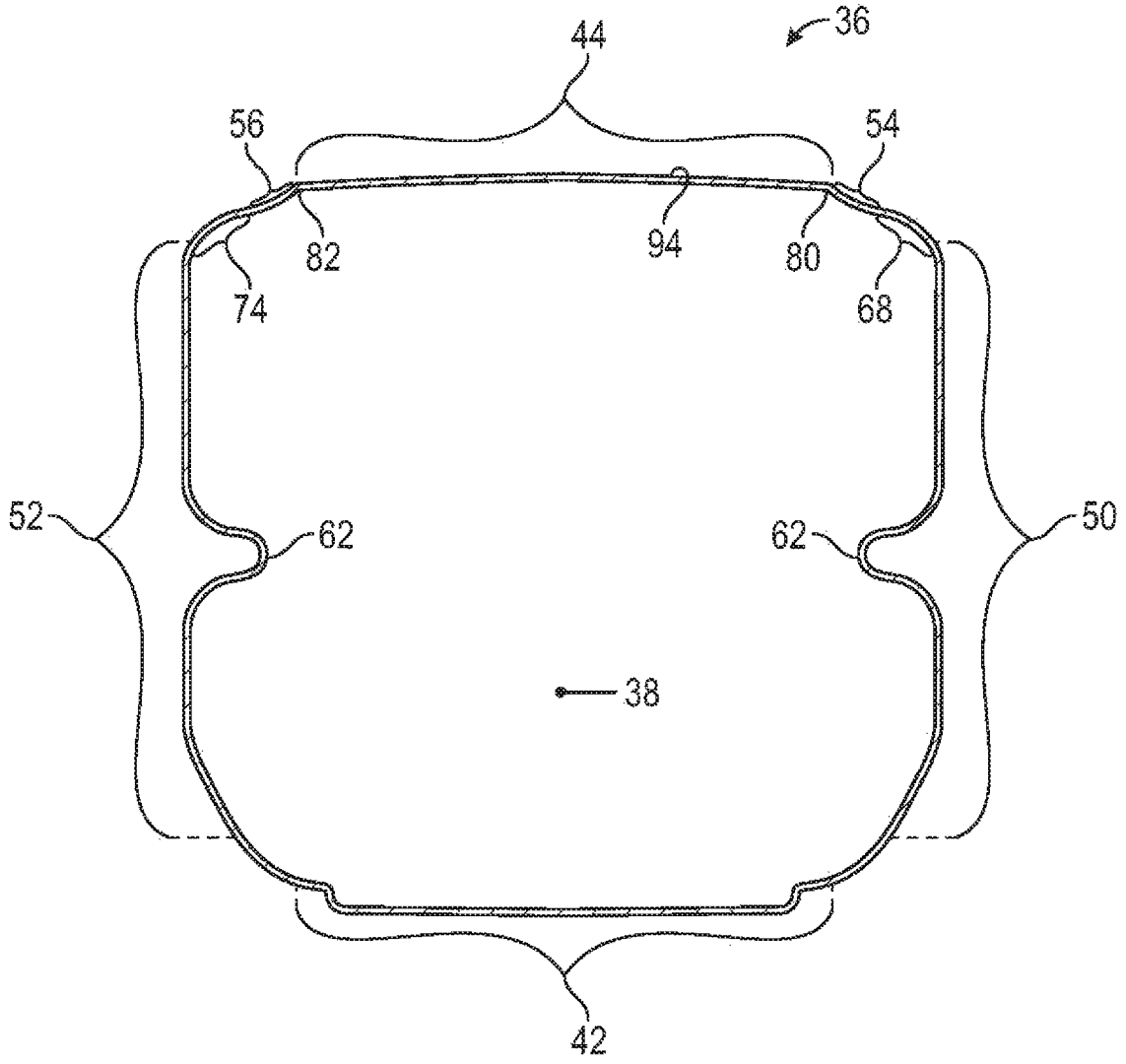
FIG. 10 is a horizontal cross-sectional view of the fluid reservoir of FIG. 4, taken along line B-B' as shown in FIG. 9, with only the cross-sectional plane shown.
Figure 11:
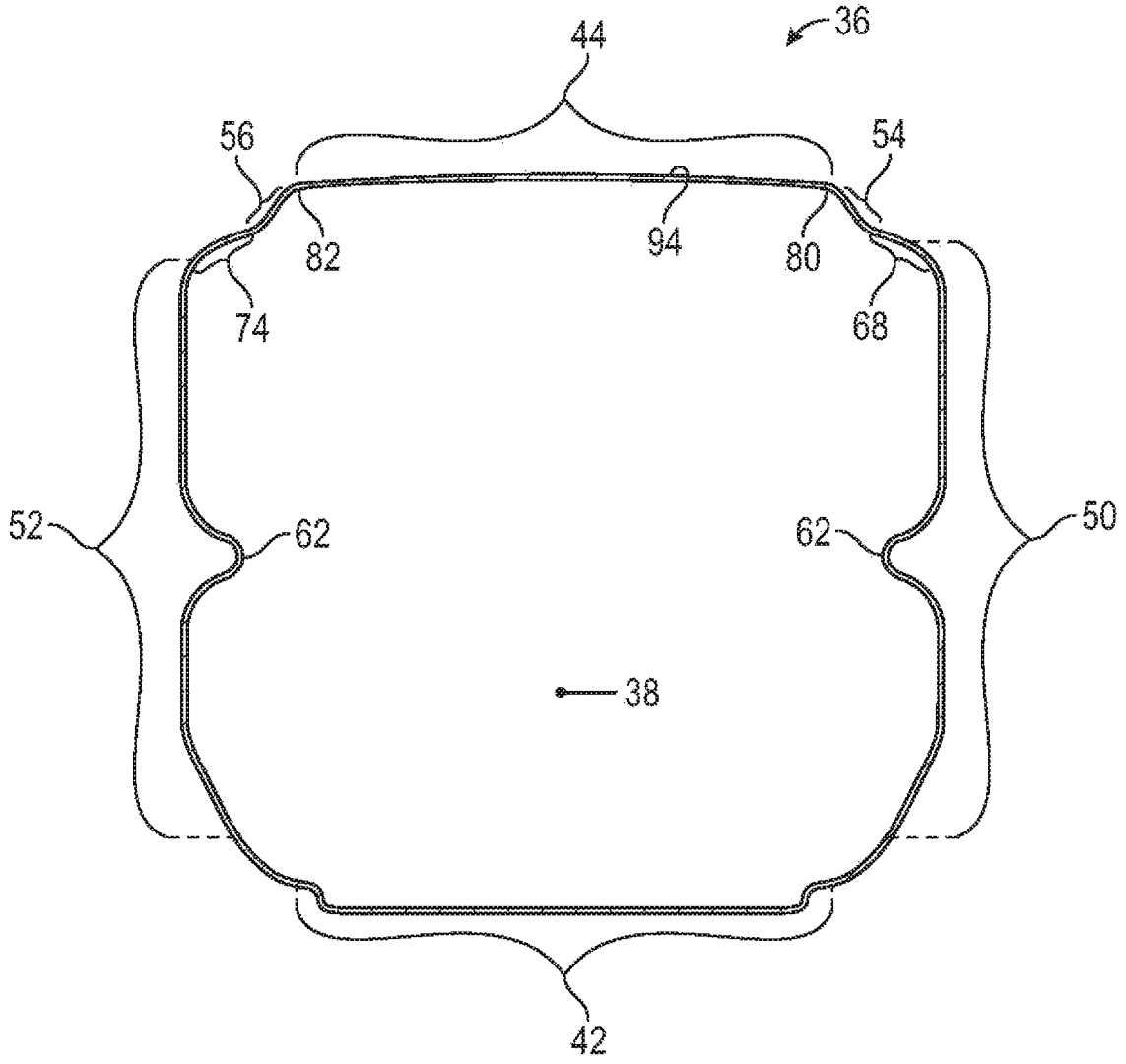
FIG. 11 is a horizontal cross-sectional view of the fluid reservoir of FIG. 4, taken along line C-C' as shown in FIG. 9, with only the cross-sectional plane shown.
Figure 12:
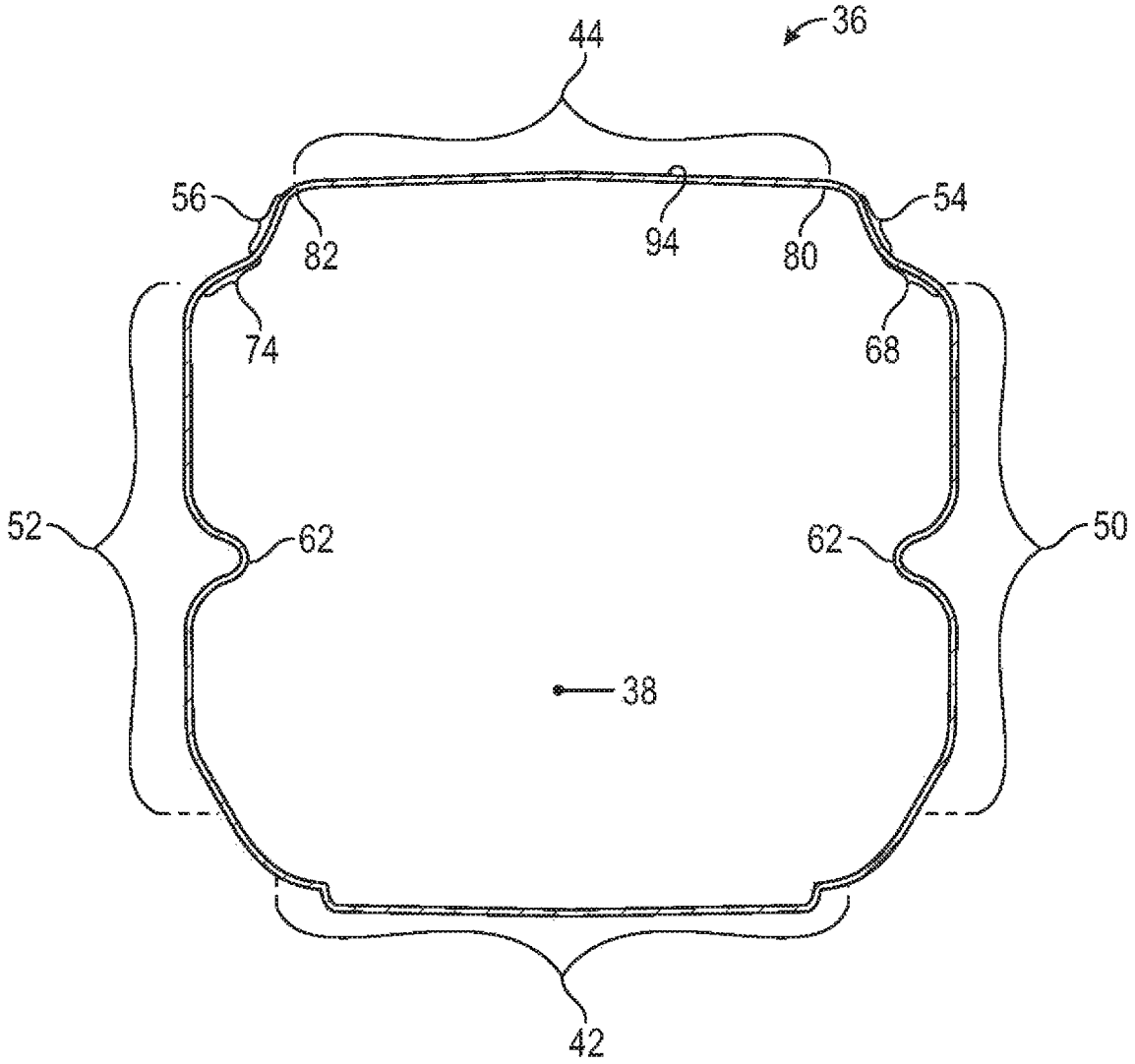
FIG. 12 is a horizontal cross-sectional view of the fluid reservoir of FIG. 4, taken along line D-D' as shown in FIG. 9, with only the cross-sectional plane shown.
Figure 13:
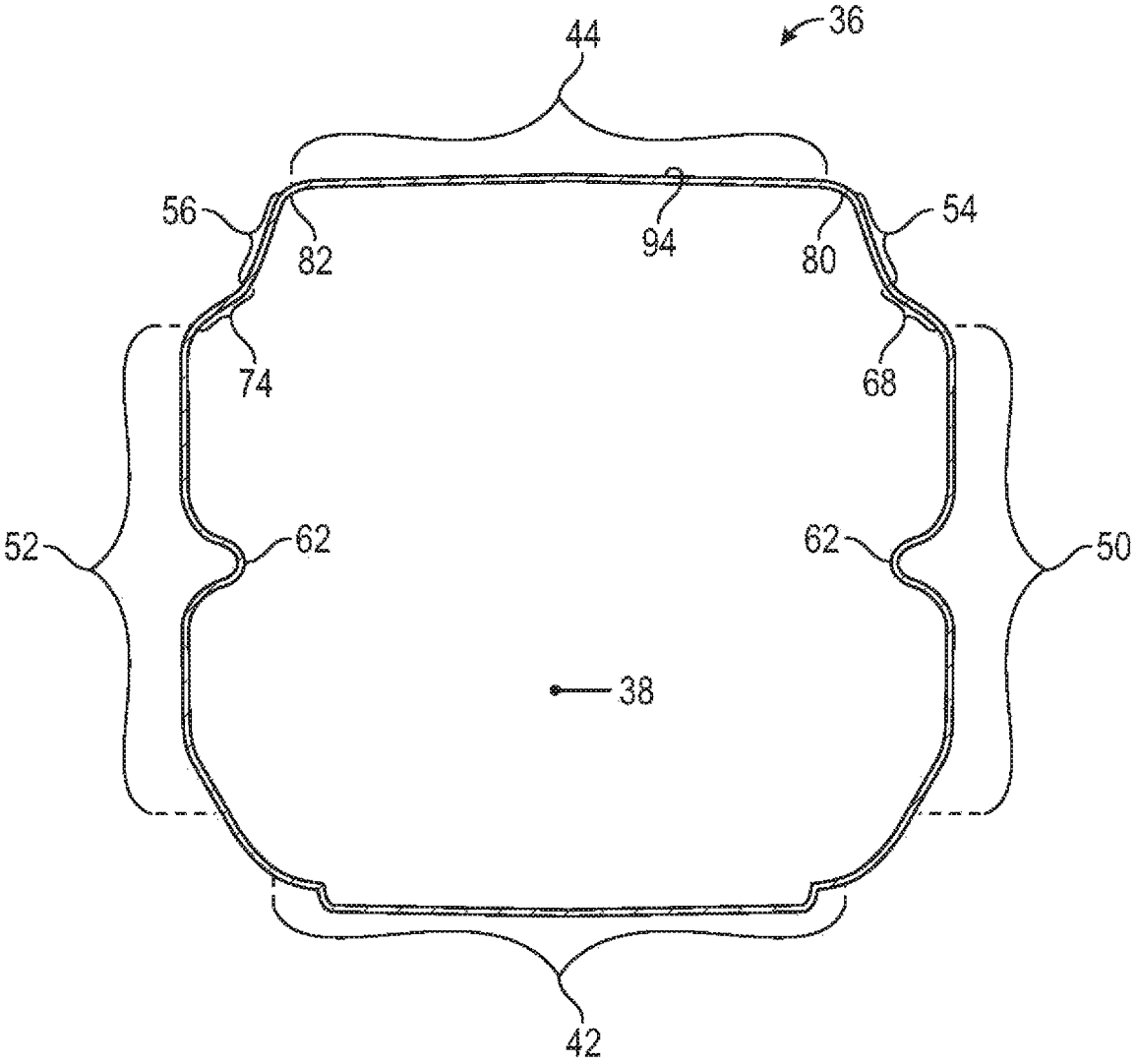
FIG. 13 is a horizontal cross-sectional view of the fluid reservoir of FIG. 4, taken along line E-E' as shown in FIG. 9, with only the cross-sectional plane shown.
Figure 14:
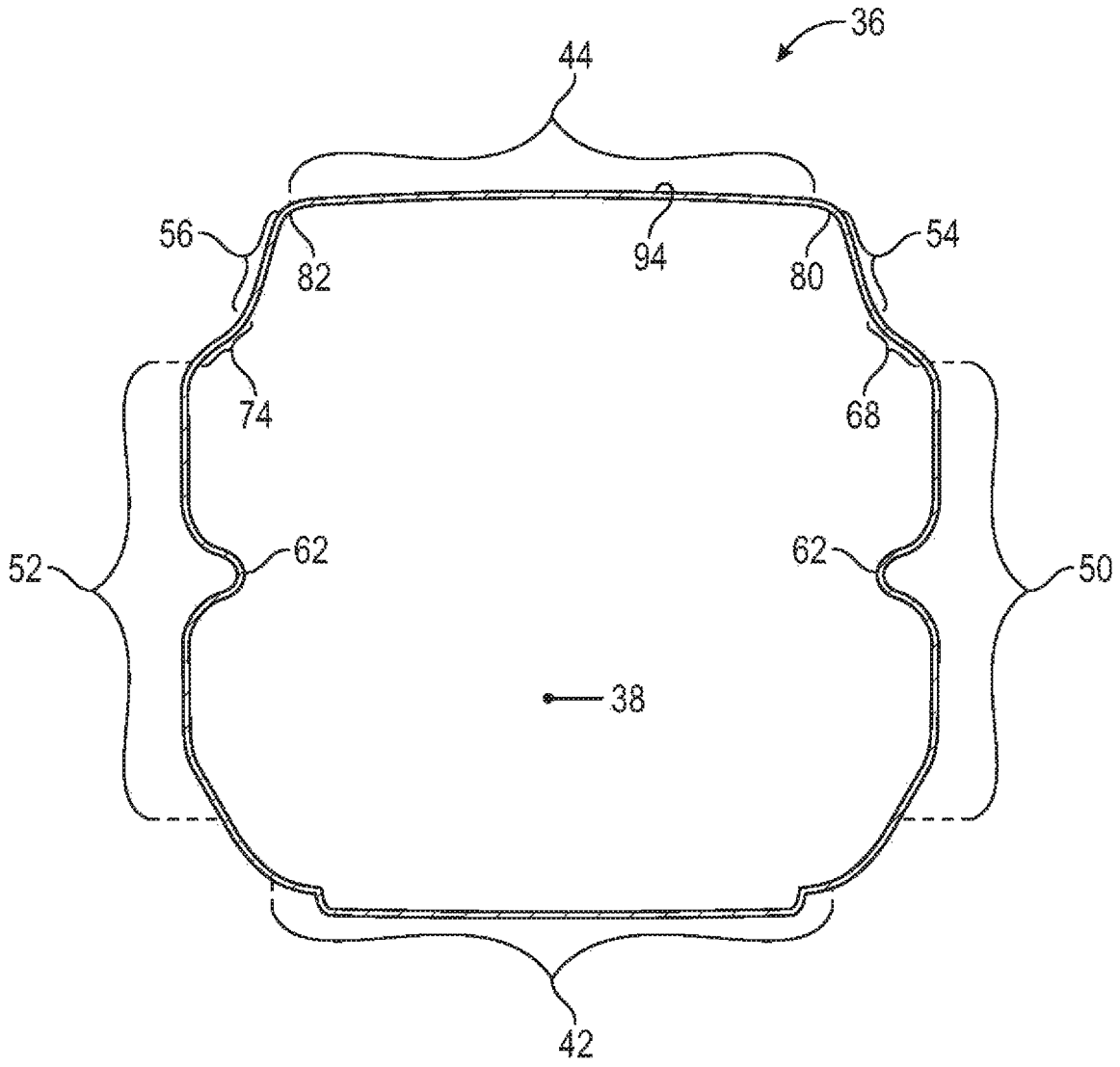
FIG. 14 is a horizontal cross-sectional view of the fluid reservoir of FIG. 4, taken along line F-F' as shown in FIG. 9, with only the cross-sectional plane shown.
Figure 15:
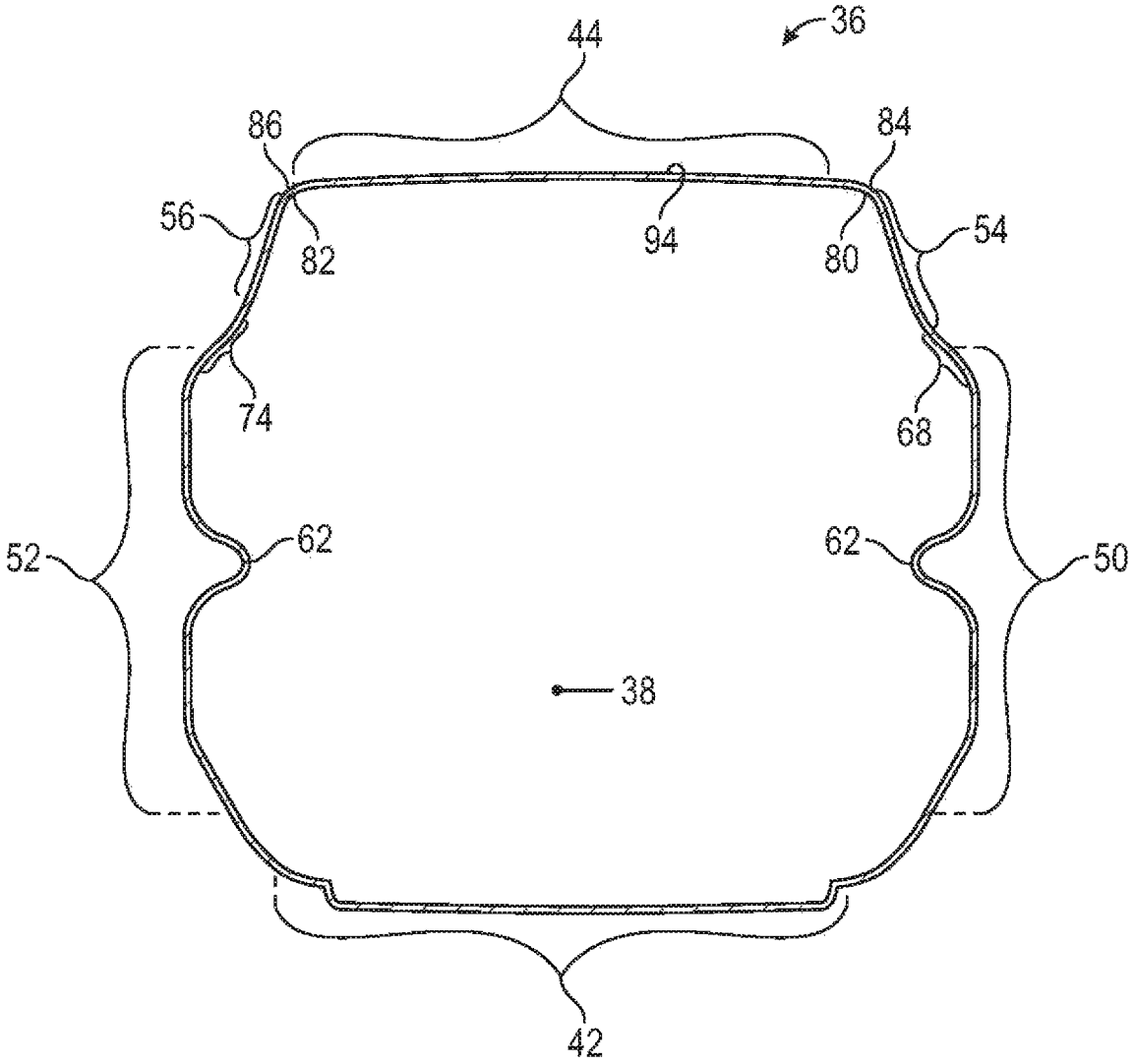
FIG. 15 is a horizontal cross-sectional view of the fluid reservoir of FIG. 4, taken along line G-G' as shown in FIG. 9, with only the cross-sectional plane shown.
Figure 16:
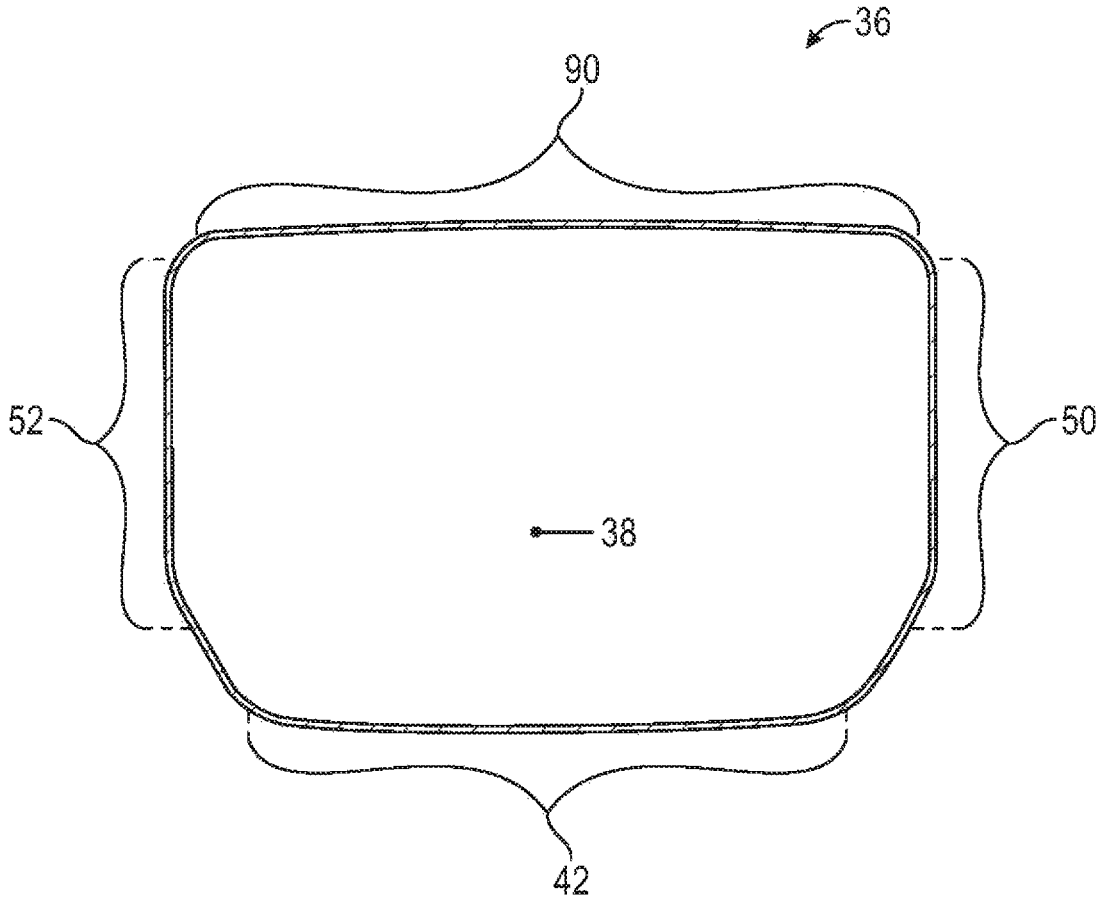
FIG. 16 is a horizontal cross-sectional view of the fluid reservoir of FIG. 4, taken along line H-H' as shown in FIG. 9, with only the cross-sectional plane shown.
Figure 17:
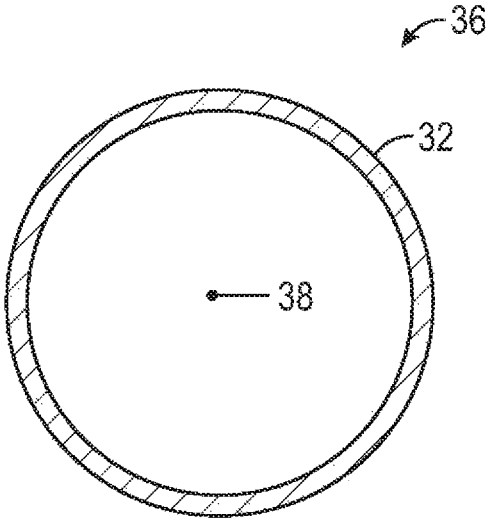
FIG. 17 is a horizontal cross-sectional view of the fluid reservoir of FIG. 4, taken along line I-I' as shown in FIG. 9, with only the cross-sectional plane shown.
Figure 18:
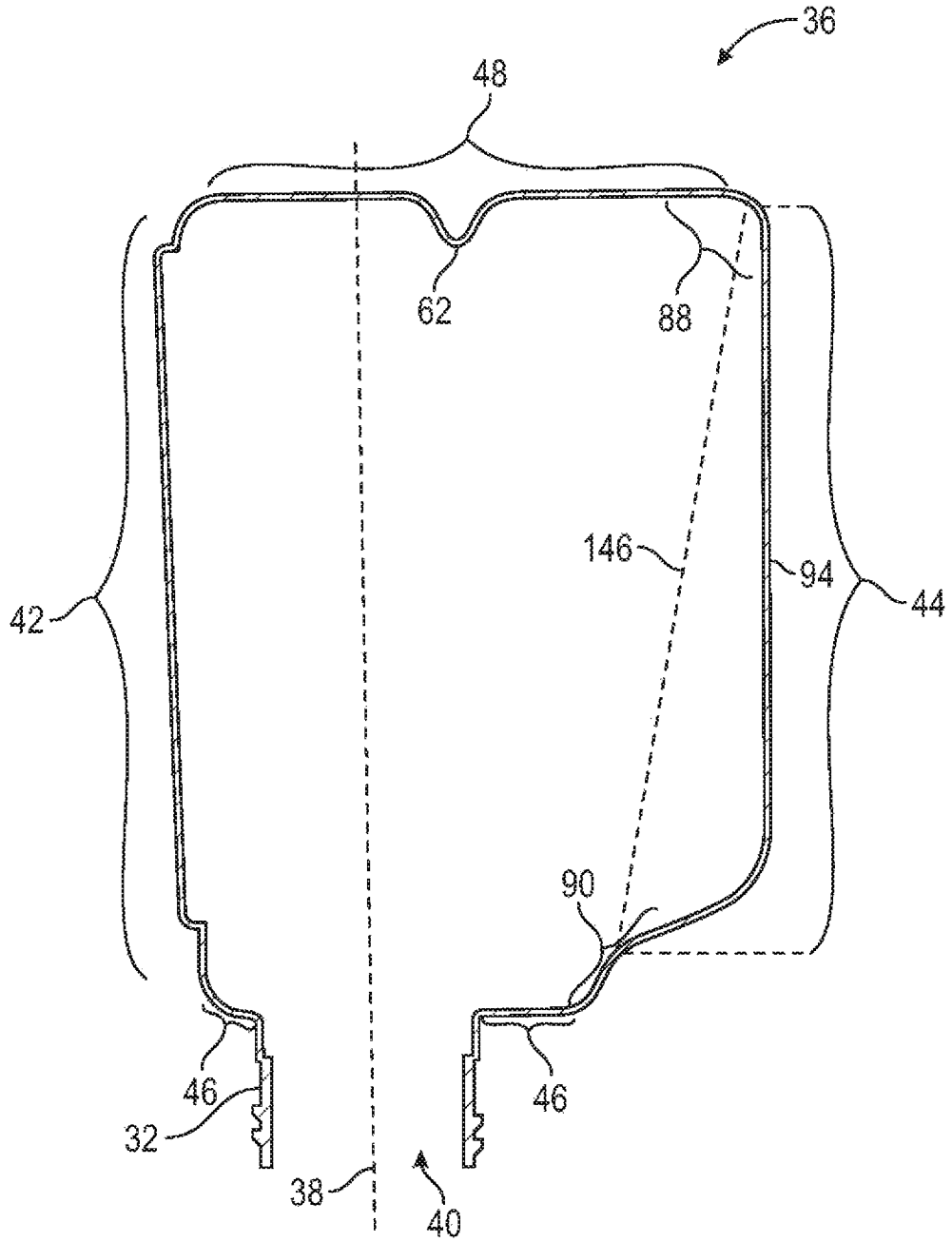
FIG. 18 is a vertical cross-sectional view of the fluid reservoir of FIG. 4, taken along line A-A' as shown in FIG. 4, with only the cross-sectional plane shown.

The left side wall 52 likewise has a left side edge portion 74 where the left side wall 52 meets the second connecting wall 56, as shown in dotted lines in FIG. 8. The left side edge portion 74 extends from a bottom left corner 76 to a top left corner 78 of the bottle 36. The bottom left corner 76 is closer to the axis 38 than the top left corner 78 is to the axis 38, and so the left side edge portion 74 is also slanted relative to the axis 38, with the left side edge portion 74 extending laterally away from the axis 38 as the left side edge portion 74 extends axially upwardly from the bottom left corner 76 to the top left corner 78.

As shown in FIGS. 5 to 8, the first connecting wall 54 and the second connecting wall 56 each have a generally triangular shape, with the first connecting wall 54 extending between the right side wall 50 and the rear wall 44, from the bottom right corner 70 to the top right corner 72, and the second connecting wall 56 extending between the left side wall 52 and the rear wall 44, from the bottom left corner 76 to the top left corner 78. The rear wall 44 has a first rear edge portion 80 where the rear wall 44 meets the first connecting wall 54, as shown in dotted lines in FIG. 6, and a second rear edge portion 82 where the rear wall 44 meets the second connecting wall 56, as shown in dotted lines in FIG. 8.

As shown in FIG. 6, the first rear edge portion 80 has a first intermediate portion 84 where the first rear edge portion 80 is furthest from the right side edge portion 68 of the right side wall 50. The first connecting wall 54 is widest at the first intermediate portion 84, and narrows moving downwardly from the first intermediate portion 84 to the bottom right corner 70, where the first rear edge portion 80 and the right side edge portion 68 meet. The first connecting wall 54 also narrows moving upwardly from the first intermediate portion 84 to the top right corner 72, where the first rear edge portion 80 and the right side edge portion 68 meet again. As shown in FIG. 8, the second rear edge portion 82 likewise has a second intermediate portion 86 where the second rear edge portion 82 is furthest from the left side edge portion 74 of the left side wall 52. The second connecting wall 56 is widest at the second intermediate portion 86, and narrows moving downwardly from the second intermediate portion 86 to the bottom left corner 76, where the second rear edge portion 82 and the left side edge portion 74 meet, and moving upwardly from the second intermediate portion 86 to the top left corner 78, where the second rear edge portion 82 and the left side edge portion 74 meet again.

As shown in FIGS. 5 to 8, the rear wall 44 extends between a top edge portion 88 where the rear wall 44 meets the top wall 48, shown in dotted lines in FIG. 6, and a bottom edge portion 90 where the rear wall 44 meets the bottom wall 46, shown in dotted lines in FIG. 8. The bottom edge portion 90 is closer to the axis 38 than the top edge portion 88 is to the axis 38. The rear wall 44 has a generally convex shape when viewed from the side, and protrudes laterally outwardly from the right side edge portion 68 of the right side wall 50 and from the left side edge portion 74 of the left side wall 52. The convex shape of the rear wall 44 is defined by the generally triangular shape of the first connecting wall 54 and the second connecting wall 56, as can be seen for example in FIGS. 6 and 8. The convex shape of the rear wall 44 can also be seen in the cross-sectional side view shown in FIG. 18, in which the rear wall 44 can be seen to bow outwardly relative to a hypothetical straight line 146 running between the top edge portion 88 and the bottom edge portion 90.

As can be seen in FIG. 7, the rear wall 44 has a flat portion 150 and a curved portion 152. The flat portion 150 is substantially parallel to the axis 38, and extends downwardly from the top edge portion 88. Because the flat portion 150 is substantially parallel to the axis 38, and the right side edge portion 68 and the left side edge portion 74 are slanted relative to the axis 38, the distance between the flat portion 150 and the right side edge portion 68, and the distance between the flat portion 150 and the left side edge portion 74, increases as the flat portion 150 extends downwardly, as can be seen in FIGS. 6 and 8. The curved portion 152 extends downwardly from the bottom of the flat portion 150, and curves laterally inwardly towards the axis 38, meeting the bottom wall 46 at the bottom edge portion 90. As shown in dotted lines in FIG. 8, an intermediate area 92 of the rear wall 44 where the rear wall 44 extends furthest from the right side edge portion 68 and the left side edge portion 74 is located between the first intermediate portion 84 of the first rear edge portion 80 and the second intermediate portion 86 of the second rear edge portion 82.

The right side edge portion 68 is also referred to herein as the first edge portion 68, the first rear edge portion 80 is also referred to as the second edge portion 80, the left side edge portion 74 is also referred to as the third edge portion 74, the second rear edge portion 82 is also referred to as the fourth edge portion 82, the bottom edge portion 90 is also referred to as the fifth edge portion 90, the top edge portion 88 is also referred to as the sixth edge portion 88, the bottom right corner 70 is also referred to as the first corner portion 70, the top right corner 72 is also referred to as the second corner portion 72, the bottom left corner 76 is also referred to as the third corner portion 76, and the top left corner 78 is also referred to as the fourth corner portion 78.

Figure 21:
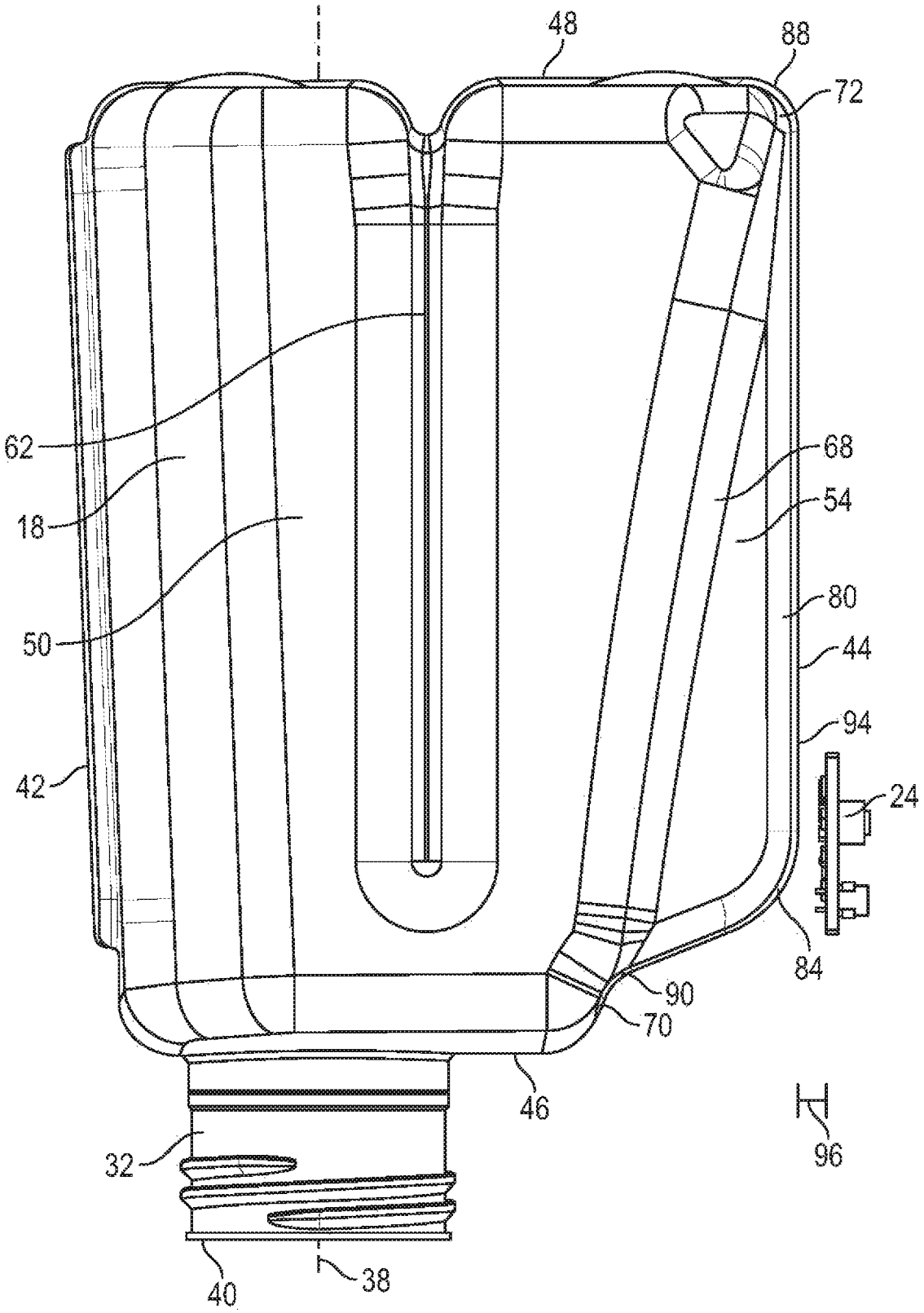
FIG. 21 is a side view of the fluid reservoir and the sensor shown in FIG. 3, showing the position of the fluid reservoir relative to the sensor when the fluid reservoir is coupled to the housing.

As best shown in FIG. 21, the bottom edge portion 90, where the rear wall 44 meets the bottom wall 46, has a generally concave shape as seen in side view. As can be seen in FIG. 20, the right side edge portion 68, where the right side wall 50 meets the first connecting wall 54, and the left side edge portion 74, where the left side wall 52 meets the second connecting wall 56, also have a generally concave shape. FIG. 20 also best shows that the first connecting wall 54 and the second connecting wall 56 are substantially planar and are slanted towards the first plane 58. More specifically, the first intermediate portion 84 of the first connecting wall 54 is closer to the first plane 58 than the bottom right corner 70 is to the first plane 58, and the first intermediate portion 84 of the first connecting wall 54 is further from the second plane 60 than the bottom right corner 70 is from the second plane 60. Similarly, the second intermediate portion 86 of the second connecting wall 56 is closer to the first plane 58 than the bottom left corner 76 is to the first plane 58, and the second intermediate portion 86 of the second connecting wall 56 is further from the second plane 60 than the bottom left corner 76 is from the second plane 60. In other words, the first connecting wall 54 and the second connecting wall 56 both extend towards the first plane 58 as they extend away from the second plane 60. The slant of the first connecting wall 54 and the second connecting wall 56, and many of the other structural features of the bottle 36, can also be seen in the cross-sectional views shown in FIGS. 10 to 17.

As can be seen in FIG. 21, when the bottle 36 is coupled to the housing 14, the rear wall 44 is positioned directly in front of the time of flight sensor 24, with an outer surface 94 of the rear wall 44 being located in the horizontal measurement path of the sensor 24. The pulses of light that are emitted by the sensor 24 are reflected back to the sensor 24 from the outer surface 94 of the rear wall 44, and the sensor 24 determines a distance 96 between the sensor 24 and the outer surface 94 of the rear wall 44 based on the amount of time it takes for the light to be reflected. The outer surface 94 is also referred to herein as the preselected surface 94.

The collapsible bottle 36 as shown in FIGS. 4 to 22 is in an initial configuration, which is the shape of the bottle 36 when the bottle 36 is filled with fluid up to its intended capacity. As fluid is dispensed from the bottle 36 by the fluid pump 16, a vacuum pressure is generated within the internal compartment 98, which causes the bottle 36 to collapse from the initial configuration towards a collapsed configuration. When in the collapsed configuration, the internal compartment 98 contains a much smaller volume of fluid than the initial volume of fluid that is contained in the internal compartment 98 when in the initial configuration. Preferably, the bottle 36 collapses until almost all of the fluid has been dispensed therefrom.

Figure 23:
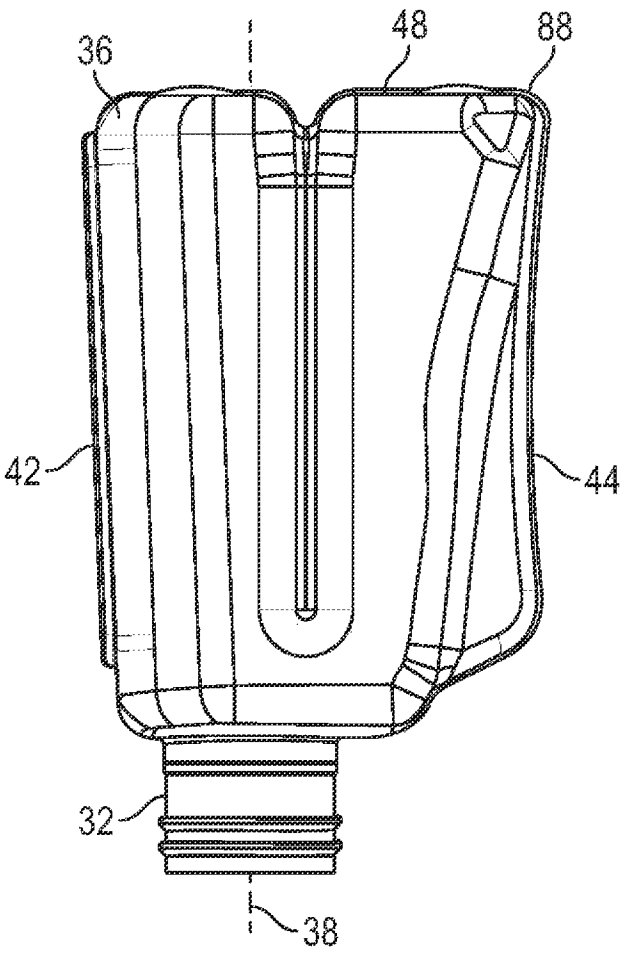
FIG. 23 is a side view of the fluid reservoir of FIG. 4 in a first partially collapsed configuration.
Figure 22:
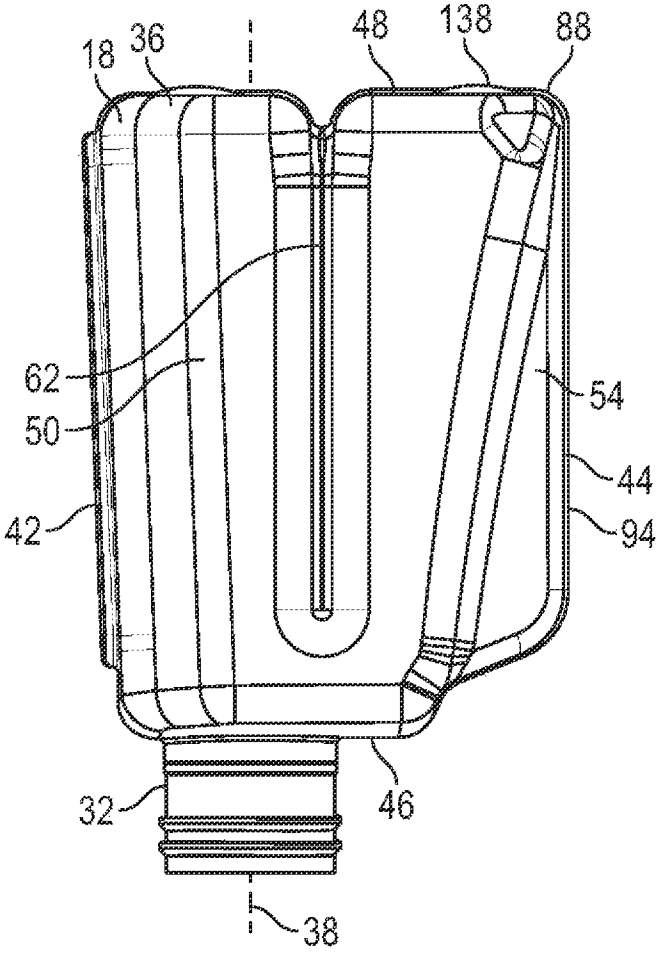
FIG. 22 is a side view of the fluid reservoir of FIG. 4 in an initial configuration.
Figure 26:
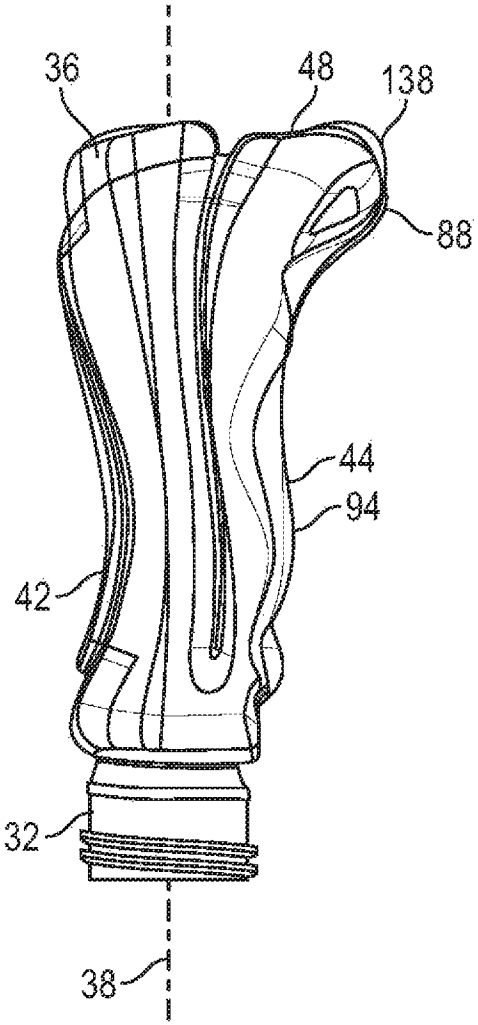
FIG. 26 is a side view of the fluid reservoir of FIG. 4 in a fourth partially collapsed configuration.
Figure 25:
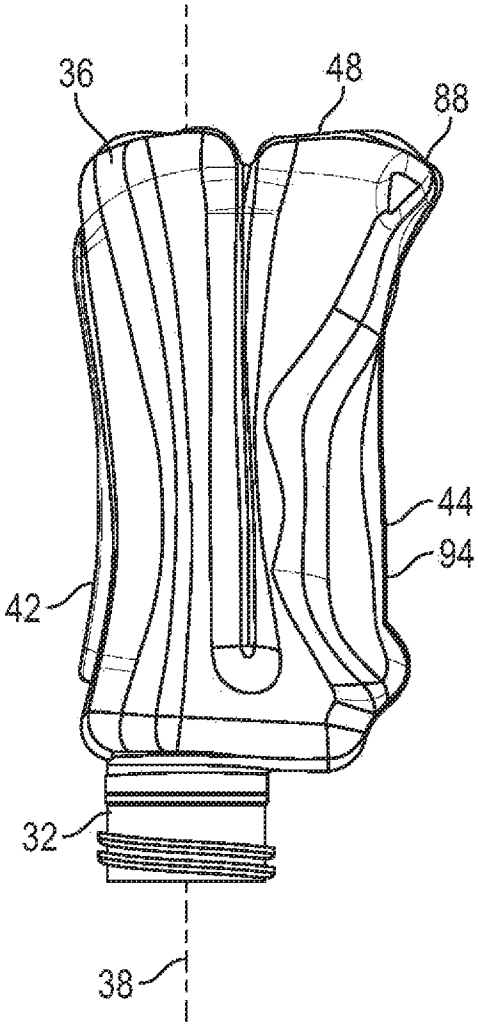
FIG. 25 is a side view of the fluid reservoir of FIG. 4 in a third partially collapsed configuration.
Figure 24:
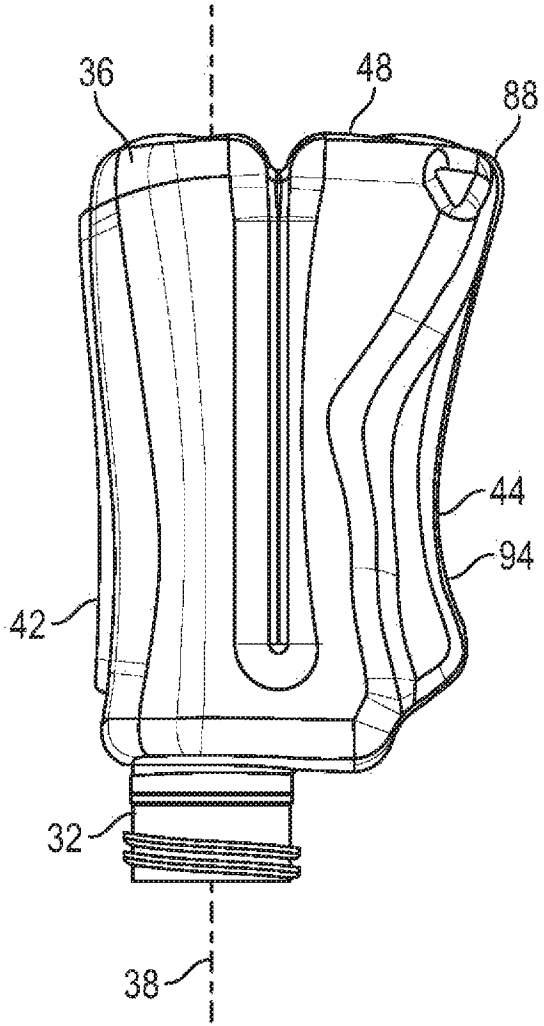
FIG. 24 is a side view of the fluid reservoir of FIG. 4 in a second partially collapsed configuration.

The bottle 36 is designed to collapse in a predictable manner, so that the distance 96 between the sensor 24 and the outer surface 94 can be used to determine the volume of fluid remaining in the bottle 36. Various stages of collapse of the bottle 36 are shown in FIGS. 22 to 26. FIG. 22 shows the bottle 36 in the initial configuration, in which the bottle 36 is 100% full of fluid up to its intended capacity. FIG. 23 shows the bottle 36 in a first partially collapsed configuration, in which the bottle 36 has less fluid than in the initial configuration. FIG. 24 shows the bottle 36 in a second partially collapsed configuration, in which the bottle 36 has less fluid than in the first partially collapsed configuration. FIG. 25 shows the bottle 36 in a third partially collapsed configuration, in which the bottle 36 has less fluid than in the second partially collapsed configuration. FIG. 26 shows the bottle 36 in a fourth partially collapsed configuration, in which the bottle 36 has less fluid than in the third partially collapsed configuration.

As can be seen by comparing FIGS. 22 to 26, as the bottle 36 collapses, the front wall 42 and the rear wall 44 move towards the axis 38 and towards each other. The rear wall 44, which is initially further from the axis 38 than the front wall 42 is from the axis 38, moves a greater distance towards the axis 38 and towards the front wall 42 than the front wall 42 moves towards the axis 38 and towards the rear wall 44. The rear wall 44 also inverts from its initial convex shape in side view, as shown in FIG. 22, to a concave shape in side view, as shown in FIG. 26. In the later stages of collapse, the rear top portion 138 of the top wall 48 buckles downwardly, as can be seen in FIG. 26.

The bottle 36 has a number of features that are selected so that the rear wall 44 moves a relatively large distance towards the axis 38, and away from the sensor 24, in a predictable manner. For example, the rear wall 44 is preferably thinner than the front wall 42, the bottom wall 46, the top wall 48, the right side wall 50, and the left side wall 52. This makes the rear wall 44 less rigid than the other walls 42, 46, 48, 50, 52, so that the rear wall 44 deforms more readily under the vacuum pressure which is generated when the fluid is dispensed.

The convex shape of the rear wall 44 also allows the rear wall 44 to move a large distance towards the axis 38 relatively easily by inverting to a concave shape. A number of features assist with allowing the rear wall 44 to invert from convex to concave. For example, the slant of the first connecting wall 54 and the second connecting wall 56 towards the first plane 58 as the first connecting wall 54 and the second connecting wall 56 extend laterally away from the second plane 60, as shown in FIG. 20, allows the rear wall 44 to invert relatively easily by bending the first intermediate portion 84 and the second intermediate portion 86 towards the axis 38. The concave shape of the bottom edge portion 90, the right side edge portion 68, and the left side edge portion 74 also make it easier to invert the rear wall 44.

The groove 62 helps to reinforce the right side wall 50, the top wall 48, and the left side wall 52, so that the rear wall 44 deforms preferentially over the right side wall 50, the top wall 48, and the left side wall 52. This further ensures that the bottle 36 collapses in a predictable manner. The uncollapsed right side wall 50, top wall 48, and left side wall 52 furthermore provide a cavity for the rear wall 44 to go into as the bottle 36 collapses. In addition, the slant of the right side edge portion 68 of the right side wall 50 and the left side edge portion 74 of the left side wall 52, as shown in FIGS. 5 to 8, gives the rear top portion 138 of the top wall 48 less support than the front top portion 136 of the top wall 48. This causes the rear top portion 138 of the top wall 48, including the top edge portion 88, to buckle downwardly in the later stages of collapse, as shown in FIG. 26, which allows the rear wall 44 to continue moving further towards the axis 38.

When the bottle 36 is coupled to the housing 14, the neck 32 and the axis 38 remain stationary relative to the housing 14. As the bottle 36 collapses, the rear wall 44 moves towards the axis 38 and away from the back plate 20 of the housing 14, and thus away from the sensor 24. The distance 96 between the sensor 24 and the outer surface 94 of the rear wall 44 thus increases as the bottle 36 collapses, with the distance 96 changing as a function of the volume of fluid remaining in the bottle 36. The distance 96 as measured by the sensor 24 can thus be used to determine the amount of fluid remaining in the bottle 36, provided the relationship between the distance 96 and the amount of fluid remaining in the bottle 36 is known.

Preferably at least one fluid dispenser 10 is used to establish the correlation between the distance 96 between the sensor 24 and the outer surface 94 and the amount of fluid remaining in the bottle 36. The fluid dispenser 10, or more preferably fluid dispensers 10, which are used to establish the correlation are referred to herein as test fluid dispensers 10. Once the testing is complete, the test fluid dispensers 10 may later be used to dispense fluid. Alternatively, the test fluid dispensers 10 may be produced for testing purposes only. In either case, the test fluid dispensers 10 are identical to production fluid dispensers 10 that are produced for the purpose of dispensing fluid, and which may not themselves be directly tested. Because the test fluid dispensers 10 and the production fluid dispensers 10 are identical, the correlation between the distance 96 and the amount of fluid remaining in the bottle 36 as determined with respect to the test fluid dispensers 10 can be applied to the production fluid dispensers 10 as well. The test fluid dispensers 10 and the production fluid dispensers 10 all correspond identically to the fluid dispenser 10 shown in FIGS. 1 to 26.

The testing procedure optionally proceeds as follows. Each test fluid dispenser 10 is provided with a collapsible bottle 36 that is filled with a test fluid, with the collapsible bottle 36 in the initial configuration as shown in FIGS. 4 to 22. The test fluid preferably corresponds to the fluid that will be dispensed from the production fluid dispensers 10. The volume of fluid that is contained in the bottle 36 when in the initial configuration is measured and recorded, and the bottle 36 is coupled to a fluid pump 16, as shown in FIG. 3. The bottle 36 and the fluid pump 16 are then coupled to the housing 14, as shown in FIG. 2, so that the outer surface 94 of the rear wall 44 is positioned in the horizontal measurement path of the sensor 24, as shown in FIG. 21. The sensor 24 is then used to measure the distance 96 between the sensor 24 and the outer surface 94 while the bottle 36 is in the initial configuration, and this information is recorded in association with the previously measured volume of fluid contained in the bottle 36.

The test fluid dispenser 10 is then repeatedly activated to dispense allotments of fluid from the bottle 36, which causes the bottle 36 to collapse. The volume of fluid remaining in the bottle 36 as the bottle 36 collapses is measured at various stages of the collapse, such as the stages shown in FIGS. 23 to 26, and preferably additional stages as well. The volume of fluid may be measured by any suitable direct or indirect method, including for example by weighing the bottle 36, by placing the bottle 36 in water and measuring the displaced volume, or by pouring the fluid from the bottle 36 into a volumetric flask. For each of the various stages of collapse in which the volume of fluid is measured, the sensor 24 is also used to measure the distance 96 between the sensor 24 and the outer surface 94, and this information is recorded in association with the measured volume of fluid.

Preferably, the testing is then repeated multiple times using multiple test fluid dispensers 10 and multiple collapsible bottles 36, to provide a suitably large data set. The data is then processed to determine the correlation between the volume of fluid contained in the bottle 36 and the distance 96 between the sensor 24 and the outer surface 94. This correlation can then be used to determine the volume of fluid contained in the bottle 36 of a production fluid dispenser 10, without requiring the volume of fluid to be directly measured, by applying the correlation to the distance 96 as measured by the sensor 24.

An exemplary method of using the fluid dispenser 10 will now be described with reference to FIGS. 1 to 26. The housing 14 of the fluid dispenser 10 may be installed in any suitable location where the dispensing of hand cleaning fluid, such as soap or hand sanitizer, is desired, such as in a washroom or healthcare facility. After the housing 14 is installed, a replaceable cartridge 110, which consists of the fluid pump 16 coupled to the collapsible bottle 36 as shown in FIG. 3, is coupled to the pump engagement body 22 of the housing 14. The collapsible bottle 36 is initially completely filled with the hand cleaning fluid and in the initial configuration as shown in FIGS. 4 to 22. The replaceable cartridge 110 is coupled to the housing 14 with the rear wall 44 of the bottle 36 facing the sensor 24, so that the outer surface 94 of the rear wall 44 is in the measurement path of the sensor 24, as shown in FIGS. 2 and 21. Once the replaceable cartridge 110 is in place, the cover 12 is placed over the replaceable cartridge 110 and coupled to the housing 14, as shown in FIG. 1. The fluid dispenser 10 is now ready to dispense the hand cleaning fluid.

To dispense an allotment of the fluid from the dispenser 10, a user's hand is placed under the fluid outlet 34. The proximity sensor detects the user's hand, which triggers the motor to activate the fluid pump 16. This process is repeated for each user that requires a dose of the fluid. As the fluid is dispensed from the bottle 36, the bottle 36 collapses as shown in FIGS. 22 to 26.

The time of flight sensor 24 periodically measures the distance 96 between the sensor 24 and the outer surface 94 of the rear wall 44 of the bottle 36, and transmits the measurement data to the processor 100 for processing. The sensor 24 may, for example, be configured to measure the distance 96 every time the fluid pump 16 is activated. This could be done by measuring the distance 96 immediately after the user's hand is detected below the fluid outlet 34, but before the fluid pump 16 is activated, or by measuring the distance 96 immediately after each activation of the pump 16. The sensor 24 could also be configured to measure the distance 96 at preset time intervals, such as every minute or every hour.

When the measurement data is received from the sensor 24, the processor 100 applies the known correlation between the distance 96 and the volume of fluid contained in the bottle 36 to calculate the volume of fluid remaining in the bottle 36. This information is then sent to the memory 102 for storage. The information may also, for example, be periodically transmitted by the wireless transmitter 104 to a server, where it can be compiled with data received from other dispensers 10, monitored for hand hygiene compliance purposes, made available for remote viewing, or used for any other desired purpose.

Optionally, the processor 100 is configured to determine when the volume of fluid remaining in the bottle 36 falls below a preselected threshold. The preselected threshold could, for example, be set at 25% fluid remaining, 10% fluid remaining, 5% fluid remaining, or any other amount that is suitable in the circumstances. When the processor 100 determines that the volume of fluid remaining in the bottle 36 has fallen below the preselected threshold, the processor 100 sends an activation signal to the LED light 108, which causes the LED light 108 to illuminate. The illuminated LED light 108 acts as a visual indicator 106 indicating to users and/or maintenance staff that the bottle 36 is nearly empty. Maintenance staff are thus able to determine whether the replaceable cartridge 110 needs to be replaced merely by looking to see whether the LED light 108 is illuminated, without having to remove the cover 12 and visually inspect the bottle 36. In some embodiments, the dispenser 10 may also incorporate a passive infrared motion sensor, not shown, which detects when a person is near the dispenser 10. The passive infrared motion sensor can be used to control the LED light 108 by, for example, only triggering the LED light 108 to be illuminated when motion is detected near the dispenser 10. This can help reduce energy costs by having the LED light 108 turn off when there is no one nearby to see whether it is illuminated. The passive infrared motion sensor may, for example, be located in the back plate 20.

The wireless transmitter 104 can also be used as a notification system 112 for notifying maintenance staff when the replaceable cartridge 110 needs to be replaced. For example, the processor 100 is optionally configured to send a notification alert to be transmitted by the wireless transmitter 104 when the volume of fluid remaining in the bottle 36 falls below the predetermined threshold. The notification alert may, for example, be in the form of a text message or e-mail that is sent to maintenance staff cell phones and/or computers. The alert may provide information such as the location of the dispenser 10 requiring a new cartridge 110, the volume of fluid remaining in the bottle 36, the type of cartridge 110 that is used in the dispenser 10, and/or the type of fluid that is dispensed from the dispenser 10.

To replace the replaceable cartridge 110, the cover 12 is removed from the housing 14 using a suitable tool. The replaceable cartridge 110 can then be removed from the pump engagement body 22 by sliding the replaceable cartridge 110 horizontally forwardly. The replaceable cartridge 110 can then be disposed of, and a new replaceable cartridge 110, with the bottle 36 completely filled with hand cleaning fluid and in the initial configuration, can be coupled to the housing 14. Once the new replaceable cartridge 110 is coupled to the housing 14, the cover 12 is placed back onto the housing 14 and the dispenser 10 is ready to continue dispensing fluid.

Figure 27:
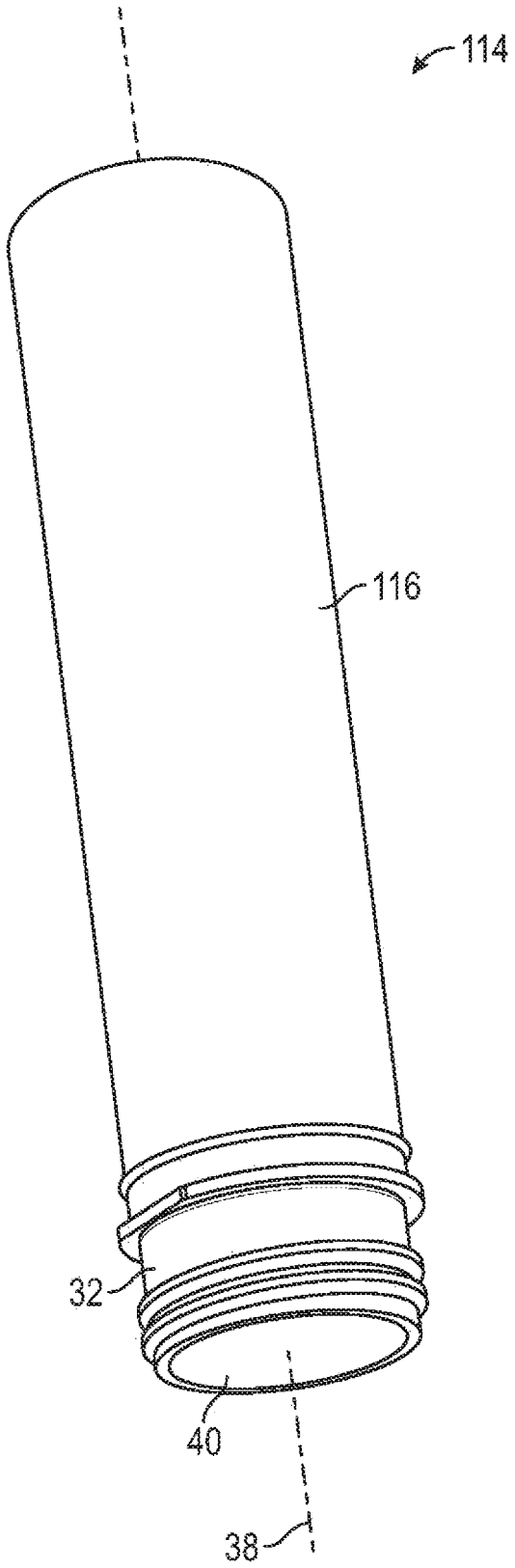
FIG. 27 is a perspective view of a preform that is used to produce the fluid reservoir of FIG. 4.

Optionally, the collapsible bottle 36 of the present invention may be produced by a blow molding process as described below. In a first stage of the process, a suitable material such as polyethylene or another polymer is melted, and the molten material is formed into a cylindrical preform 114 by injection molding, or by any other suitable process as known in the art. The preform 114 may, for example, have the shape and configuration as shown in FIG. 27. As can be seen in FIG. 27, the preform 114 includes the threaded neck 32 of the bottle 36, and a cylindrical preform wall 116 that extends concentrically about the axis 38. The preform wall 116 preferably has a substantially uniform thickness. In a second stage of the process, the preform 114 is heated above its glass transition temperature and placed in a mold, and high pressure air is injected into the opening 40. This causes the preform wall 116 to inflate and expand into the shape of the mold, with the expanded preform wall 116 forming the front wall 42, the rear wall 44, the top wall 48, the right side wall 50, the left side wall 52, the first connecting wall 54, and the second connecting wall 56 of the bottle 36. The bottle 36 is then removed from the mold once it has sufficiently cooled and hardened.

The blow molding process allows the rear wall 44 to be made thinner than the front wall 42, the right side wall 50, and the left side wall 52. In particular, the thickness of the preform wall 116 decreases as it expands radially outwardly from the axis 38. Because the rear wall 44 is further from the axis 44 than the front wall 42, the right side wall 50, and the left side wall 52, as can be seen in FIG. 19, this causes the rear wall 44 to be thinner than the front wall 42, the right side wall 50, and the left side wall 52. As described above, this makes it easier to deform the rear wall 44 in comparison with the front wall 42, the right side wall 50, and the left side wall 52, with the result that the rear wall 44 deforms first and to the greatest extent when the bottle 36 collapses.

The collapsible bottle 36 of the present invention could also be produced by any other suitable process, including by extrusion blow molding. In an extrusion blow molding process, a hot tube of a suitable polymer, called a parison, is extruded and captured by a cooled mold. Air is then blown into the parison, inflating it into the shape of the bottle 36.

As with the injection blow molding process described above, in an extrusion blow molding process the rear wall 44 can also be made thinner than the front wall 42, the right side wall 50, and the left side wall 52, by positioning the rear wall 44 further from the axis 38 than the front wall 42, the right side wall 50, and the left side wall 52.

Figure 28:
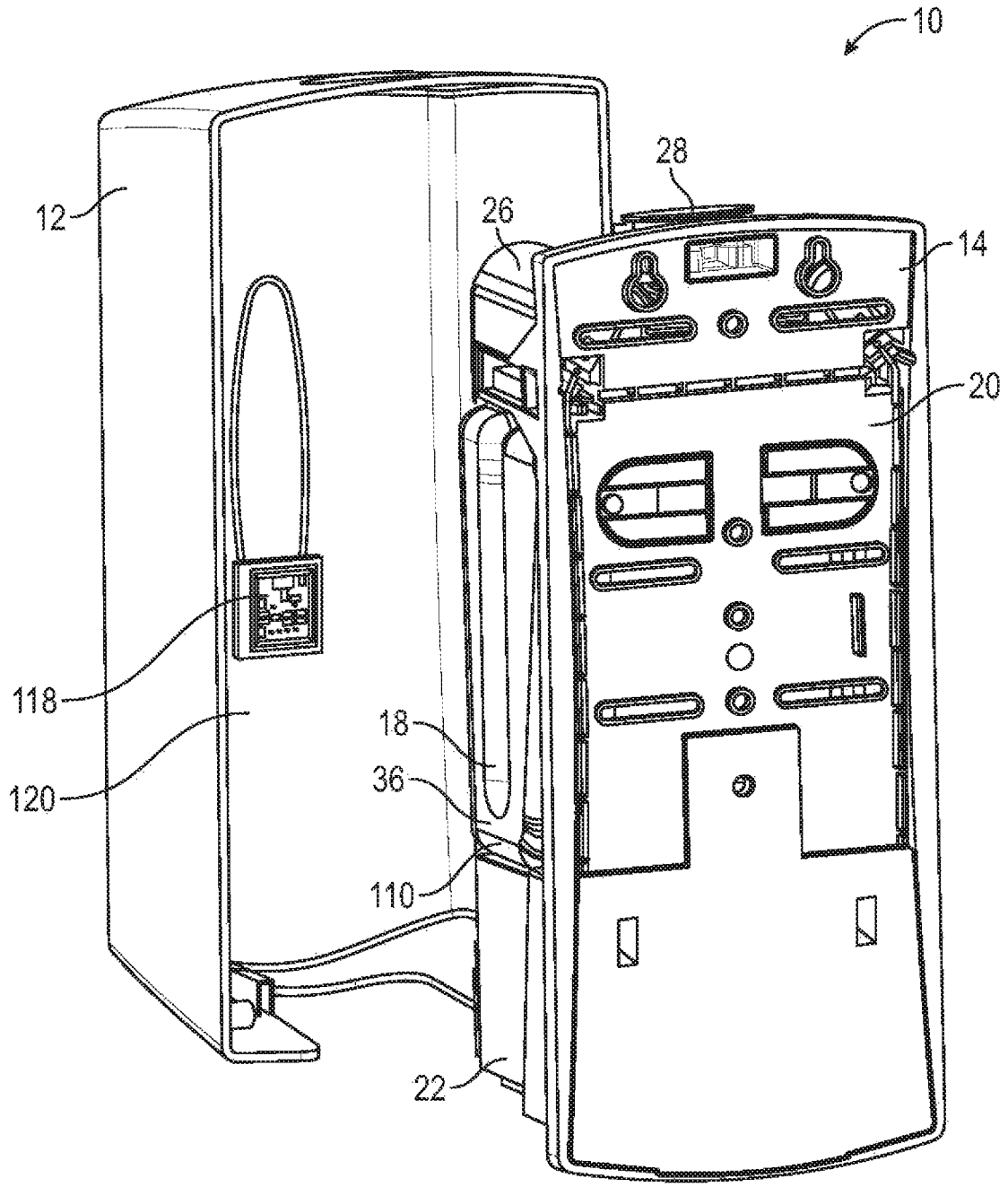
FIG. 28 is a rear perspective view of a fluid dispenser in accordance with a second embodiment of the present invention, with a cover of the fluid dispenser removed.
Figure 29:
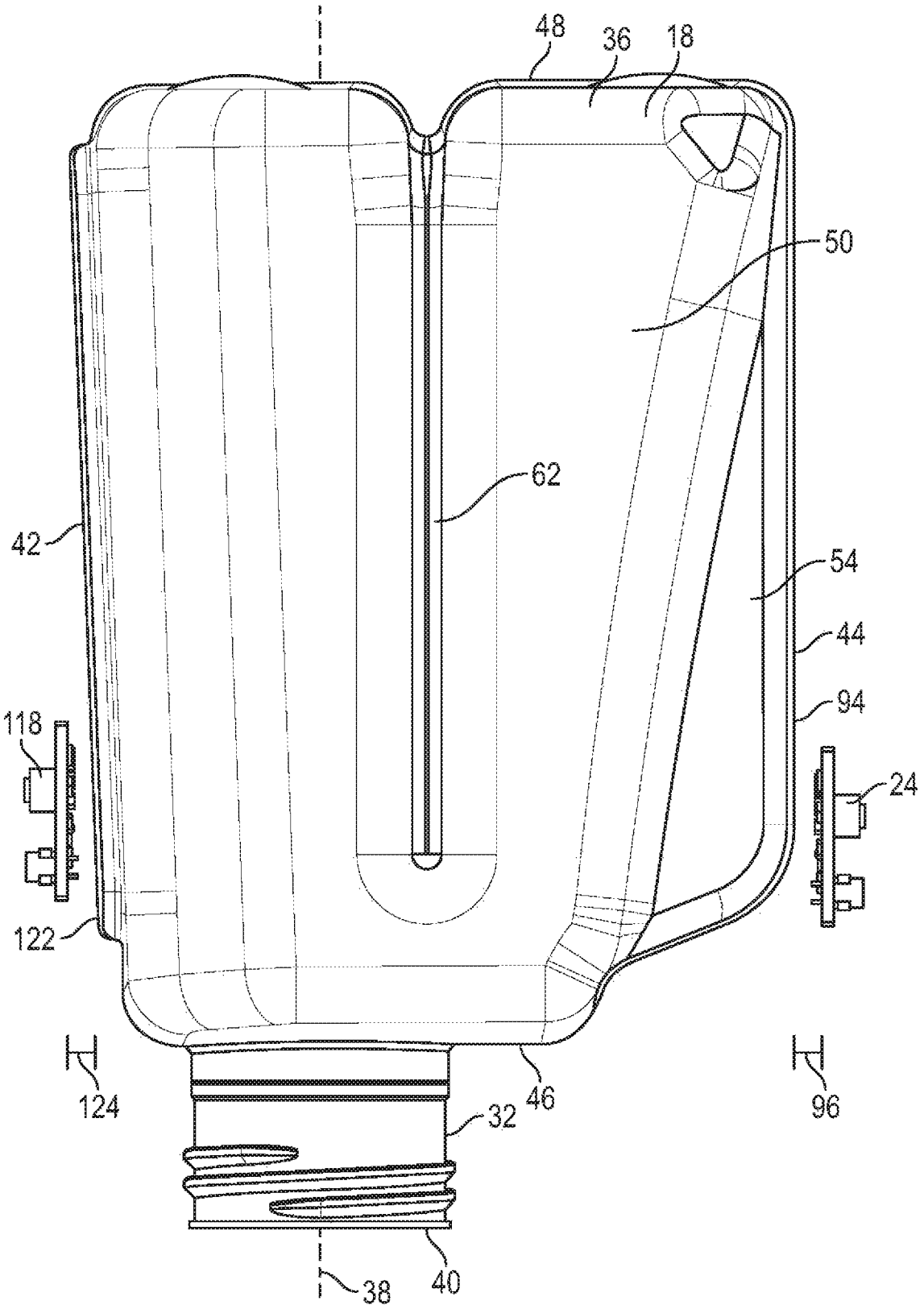
FIG. 29 is a side view of a fluid reservoir of the fluid dispenser of FIG. 28, showing the position of the fluid reservoir relative to two sensors.

Reference is now made to FIGS. 28 and 29, which show a fluid dispenser 10 in accordance with a second preferred embodiment of the invention. The dispenser 10 shown in FIGS. 28 and 29 is identical to the dispenser 10 shown in FIGS. 1 to 26, with the only difference being the addition of a second time of flight sensor 118. Like numerals are used to denote like components.

As can be seen in FIG. 28, the second time of flight sensor 118 is placed on an inside surface 120 of the cover 12. When the cover 12 is coupled to the housing 14, the second time of flight sensor 118 faces rearwardly towards an exterior surface 122 of the front wall 42 of the collapsible bottle 36. The second time of flight sensor 118 is configured to emit a pulse of light horizontally rearwardly towards the exterior surface 122, and to detect when the pulse of light is reflected back to the second sensor 118 from the exterior surface 122. The second sensor 118 is able to determine a distance 124 between the second sensor 118 and the exterior surface 122 based on the time it takes for the pulse of light to be reflected back to the second sensor 118 from the exterior surface 122. The exterior surface 122 is also referred to herein as the second preselected surface 122.

As can be seen in FIGS. 22 to 26, the front wall 42 moves towards the axis 38 as the collapsible bottle 36 collapses. As such, the distance 124 between the second sensor 118 and the exterior surface 122 changes in a predictable manner as a function of the volume of fluid remaining in the bottle 36. The measurement data from the second time of flight sensor 118 can therefore supplement the measurement data from the first time of flight sensor 24, and may help to provide a more accurate determination of the amount of fluid remaining in the bottle 36. For example, if there is any variability in the positioning of the collapsible bottle 36 relative to the housing 14, or in the collapse pattern of the bottle 36, having measurement data from both sensors 24, 118 may help to detect and control for this variability. The fluid dispenser 10 shown in FIGS. 28 and 29 functions identically to the dispenser 10 shown in FIGS. 1 to 26, except that the second sensor 118 periodically measures the distance 124 between the second sensor 118 and the exterior surface 122 of the front wall 42, and the processor 100 uses the measurement data from both sensors 24, 118 to determine the volume of fluid remaining in the bottle 36.

Figure 30:
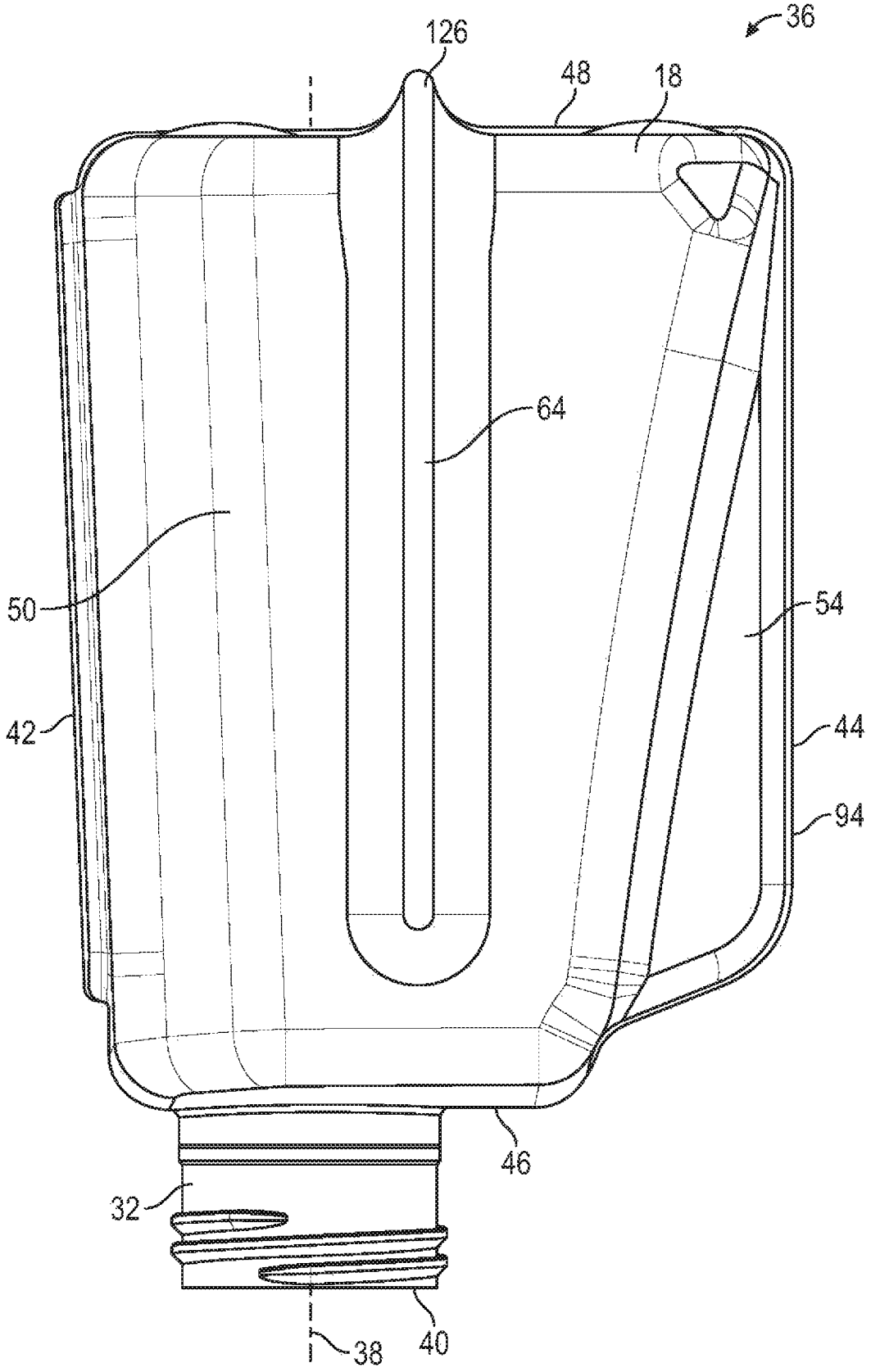
FIG. 30 is a side view of a fluid reservoir in accordance with a third embodiment of the present invention.
Figure 31:
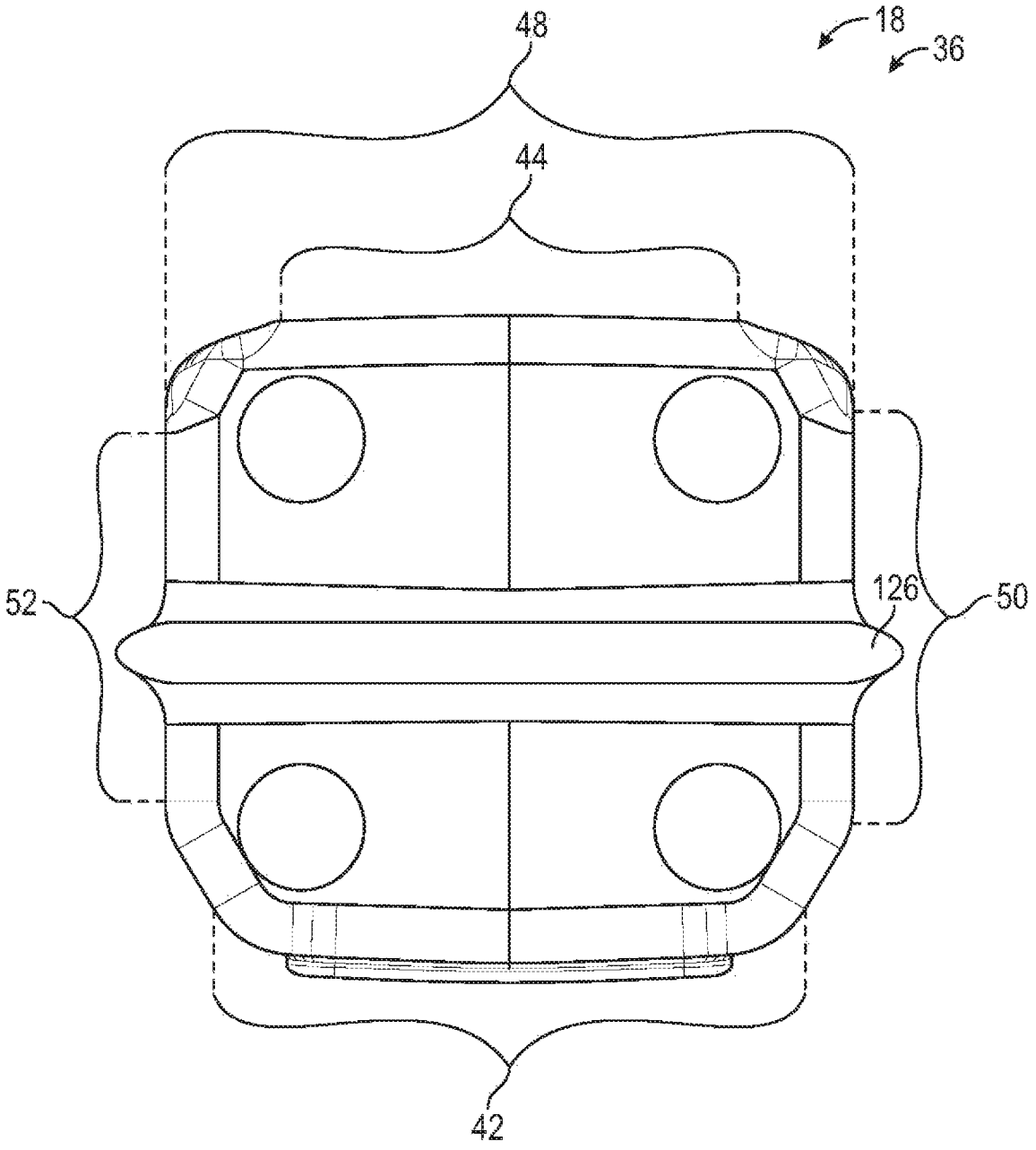
FIG. 31 is a top view of the fluid reservoir of FIG. 30.

A collapsible bottle 36 in accordance with a third preferred embodiment of the invention is shown in FIGS. 30 and 31. The collapsible bottle 36 shown in FIGS. 30 and 31 is identical to the bottle 36 shown in FIGS. 2 to 26, with the only difference being that the groove 62 has been replaced by a rib 126. Like numerals are used to denote like components.

The collapsible bottle 36 shown in FIGS. 30 and 31 may be used to dispense fluid from the fluid dispenser 10 shown in FIGS. 1 to 3, and functions in the same way as the collapsible bottle 36 shown in FIGS. 2 to 26. The rib 126 provides reinforcement to the right side wall 50, the top wall 48, and the left side wall 52, similarly to the groove 62. This helps to ensure that the bottle 36 collapses in a predictable manner, with the rear wall 44 deforming first and to the greatest extent. The rib 126 could be made larger or smaller than is shown in FIGS. 30 and 31, and preferably the size of the rib 126 is selected so that it takes up relatively little space within the housing 14. More than one rib 126, more than one groove 62, a combination of one or more ribs 126 and grooves 62, or any other suitable reinforcement structure 64 or reinforcement structures 64 could also be used. The grooves 62 and the ribs 126 could also extend a shorter distance or a longer distance than is shown in the drawings, or could extend across different walls 50, 48, 52 than is shown in the drawings. For example, the groove 62 and/or the rib 126 could optionally extend all the way down to the bottom of the right side wall 50 and the left side wall 52. Alternatively, the groove 62 and/or the rib 126 could optionally extend only about half way down the right side wall 50 and the left side wall 52. In other embodiments, the right side wall 50 and the left side wall 52 could optionally each have a groove 62 which does not extend across the top wall 48, or which only extends across part of the top wall 48.

Each of the embodiments shown in FIGS. 1 to 31 and described above therefore provide a collapsible bottle 36 defining a variable volume internal compartment 98 for containing a fluid to be dispensed from a fluid dispenser 10, the collapsible bottle 36 comprising: a first exterior wall 44; a second exterior wall 42; a third exterior wall 46; and a neck 32 that extends along an axis 38 away from the third exterior wall 46, the neck 32 having an opening 40 in fluid communication with the internal compartment 98; wherein the internal compartment 98 contains an initial volume of the fluid when the collapsible bottle 36 is in an initial configuration; wherein, as the fluid is dispensed from the collapsible bottle 36, the collapsible bottle 36 deforms from the initial configuration towards a collapsed configuration, the internal compartment 98 containing a smaller volume of the fluid when in the collapsed configuration than when in the initial configuration; wherein the first exterior wall 44 is thinner than the second exterior wall 42; wherein the first exterior wall 44 is further from the axis 38 than the second exterior wall 42 is from the axis 38 when the collapsible bottle 36 is in the initial configuration; and wherein the first exterior wall 44 moves towards the axis 38 as the collapsible bottle 36 deforms from the initial configuration towards the collapsed configuration.

Each of the embodiments shown in FIGS. 1 to 31 and described above therefore also provide a method comprising: providing a fluid dispenser 10, the fluid dispenser 10 having a distance measuring sensor 24; providing a collapsible bottle 36, the collapsible bottle 36 containing a fluid to be dispensed from the fluid dispenser 10; coupling the collapsible bottle 36 to the fluid dispenser 10 so that a preselected surface 94 of the collapsible bottle 36 is positioned in a measurement path of the sensor 24; activating the fluid dispenser 10 to dispense an allotment of the fluid from the collapsible bottle 36, the collapsible bottle 36 collapsing as the fluid is dispensed from the collapsible bottle 36; using the sensor 24 to measure a distance 96 between the sensor 24 and the preselected surface 94 of the collapsible bottle 36, the distance 96 changing as the collapsible bottle 36 collapses; and determining a volume of the fluid contained in the collapsible bottle 36 based on the distance 96 between the sensor 24 and the preselected surface 94 of the collapsible bottle 36.

Each of the embodiments shown in FIGS. 1 to 31 and described above therefore also provide a fluid dispenser 10 comprising: a collapsible bottle 36 containing a fluid to be dispensed; a fluid pump 16 for dispensing the fluid from the collapsible bottle 36; and a distance measuring sensor 24 arranged to detect a distance 96 between the sensor 24 and a preselected surface 94 of the collapsible bottle 36; wherein the collapsible bottle 36 collapses as the fluid is dispensed from the collapsible bottle 36, and the distance 96 between the sensor 24 and the preselected surface 94 of the collapsible bottle 36 changes as the collapsible bottle 36 collapses.

It will be understood that, although various features of the invention have been described with respect to one or another of the embodiments of the invention, the various features and embodiments of the invention may be combined or used in conjunction with other features and embodiments of the invention as described and illustrated herein.

The fluid dispenser 10 is not limited to the particular construction shown and described herein. For example, the fluid dispenser 10 could be designed for manual operation rather than automatic operation. The fluid dispenser 10 could also be configured to dispense fluid from an upwardly oriented bottle 36 instead of a downwardly oriented bottle 36, with the bottle 36 having the same construction or a different construction from that shown in the drawings. The bottle 36 could have any suitable construction that collapses in a predictable manner, and is not limited to the particular embodiments shown. For example, the bottle 36 could be designed so that the front wall 42, the rear wall 44, the bottom wall 46, the top wall 48, the right side wall 50, and/or the left side wall 52 deform to a greater or lesser extent, and with a different order and/or pattern of movement, from that described in the preferred embodiments. The bottle 36 could incorporate any suitable structure or combination of structures that provide a predictable pattern of collapse. For example, in an alternative embodiment the bottle 36 could have a bellow shaped back region that allows the rear wall 44 to move towards the axis 38 as the bellow collapses. Although the preferred embodiments of the invention include a groove 62 and/or a rib 126, these reinforcement structures 64 are not necessary in all embodiments of the invention. Nor is the convex shape of the rear wall 44 necessary in all embodiments. In other embodiments, the rear wall 44 could have a flat or concave shape. The rear wall 44 could also have a convex shape that differs from that shown in the drawings. For example, the rear wall 44 could have a convex shape when viewed from above rather than from the side, or could have a convex shape when viewed both from above and from the side. Nor is it strictly necessary for the rear wall 44 to be further from the axis 38 and/or thinner than the front wall 42.

The sensor 24 could also be located at a different position than that shown in the drawings. For example, for bottles 36 having a collapse pattern in which the top wall 48 moves first and to the greatest extent, the sensor 24 could be positioned at the top of the cover 12 facing vertically downwardly towards the top wall 48. Any positioning and/or orientation of the sensor 24 that is suitable for a given dispenser 10 construction and bottle 36 construction may be selected. The dispenser 10 could also be provided with more than two time of flight sensors 24, 118, with for example each time of flight sensor 24, 118 measuring the distance to a different wall 42, 44, 48, 50, 52, 54, 56 of the bottle 36, and/or to a different portion of the same wall 42, 44, 48, 50, 52, 54, 56. Any type of sensor 24, 118 that provides a suitably accurate distance measurement could be used, and the invention is not limited to time of flight sensors 24, 118 as described in the preferred embodiments.

Optionally, the measurement data from the sensor 24 may be used to determine whether there is a replaceable cartridge 110 coupled to the housing 14, and/or whether the replaceable cartridge 110 has been installed correctly. For example, if there is no replaceable cartridge 110 coupled to the housing 14, then the sensor 24 will detect the distance between the sensor 24 and the cover 12, which will be much greater than the expected distance 96 between the sensor 24 and the outer surface 94 of the rear wall 44. This large distance measurement can be interpreted by the processor 100 as indicating that there is no replaceable cartridge 110 coupled to the housing 14, and this information can be conveyed to maintenance staff by, for example, illuminating the LED light 108 or sending an notification alert via the notification system 112. Likewise, if the replaceable cartridge 110 has been installed incorrectly, for example by placing the rear wall 44 facing forwards and the front wall 42 facing backwards, then the sensor 24 will detect a distance that is different than the expected distance 96 between the sensor 24 and the outer surface 94 of the rear wall 44. This unexpected distance measurement can be interpreted by the processor 100 as indicating that the replaceable cartridge 110 has been installed incorrectly, and the processor 100 can notify maintenance staff by, for example, illuminating the LED light 108 or sending an notification alert via the notification system 112.

The fluid dispenser 10 does not necessarily need to have a processor 100, a memory 102, a wireless transmitter 104, a visual indicator 106, an LED light 108, and/or a notification system 112. For example, the fluid dispenser 10 could be configured to transmit the measurement data from the sensor 24 directly to an external computer, for example through a wired connection or the like, and all processing and interpretation of the data could be done by the external computer. Other types of visual indicators 106, such as electronic display screens or the like, could also be used.

Although the fluid is preferably a hand cleaning fluid, such as hand soap, hand disinfectant or hand sanitizer, the dispenser 10 could be used to dispense other fluids as well. The term "fluid" as used herein includes any flowable substance, including liquids, foams, emulsions, and dispersions.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

We claim:

1. A collapsible bottle defining a variable volume internal compartment for containing a fluid to be dispensed from a fluid dispenser, the collapsible bottle comprising:

a first exterior wall;

a second exterior wall;

a third exterior wall; and a neck that extends along an axis away from the third exterior wall, the neck having an opening in fluid communication with the internal compartment;

wherein the internal compartment contains an initial volume of the fluid when the collapsible bottle is in an initial configuration;

wherein, as the fluid is dispensed from the collapsible bottle, the collapsible bottle deforms from the initial configuration towards a collapsed configuration, the internal compartment containing a smaller volume of the fluid when in the collapsed configuration than when in the initial configuration;

wherein the first exterior wall is thinner than the second exterior wall;

wherein the first exterior wall is further from the axis than the second exterior wall is from the axis when the collapsible bottle is in the initial configuration;

wherein the first exterior wall moves towards the axis as the collapsible bottle deforms from the initial configuration towards the collapsed configuration;

wherein the first exterior wall and the second exterior wall are each intersected by a first plane that contains the axis;

wherein the collapsible bottle has a fourth exterior wall and a fifth exterior wall that are each intersected by a second plane that contains the axis, the second plane being perpendicular to the first plane;

wherein the collapsible bottle has a sixth exterior wall that is intersected by the axis;

wherein the fourth exterior wall, the fifth exterior wall, and the sixth exterior wall have a reinforcement structure that resists deformation of the fourth exterior wall, the fifth exterior wall, and the sixth exterior wall as the collapsible bottle deforms from the initial configuration towards the collapsed configuration, wherein the reinforcement structure comprises a groove.

2. The collapsible bottle according to claim 1, wherein a vacuum is generated within the collapsible bottle when the fluid is dispensed from the collapsible bottle, the vacuum causing the collapsible bottle to collapse in a predictable manner.

3. The collapsible bottle according to claim 1, wherein, as the collapsible bottle collapses, the first exterior wall moves towards the second exterior wall.

4. The collapsible bottle according to claim 1, wherein the first exterior wall moves a greater distance towards the second exterior wall than the second exterior wall moves towards the first exterior wall as the collapsible bottle collapses.

5. The collapsible bottle according to claim 1, wherein the first exterior wall has a convex shape when the collapsible bottle is in the initial configuration, and has a concave shape when the collapsible bottle is in the collapsed configuration.

6. The collapsible bottle according to claim 1, wherein the groove at least partially extends across the fourth exterior wall, the fifth exterior wall, and the sixth exterior wall; and wherein the groove is located where a third plane intersects the fourth exterior wall, the fifth exterior wall, and the sixth exterior wall, the third plane being parallel to the second plane.

7. The collapsible bottle according to claim 1, wherein the collapsible bottle has a first connecting wall that extends between the fourth exterior wall and the first exterior wall; and a second connecting wall that extends between the fifth exterior wall and the first exterior wall;

wherein the collapsible bottle has a first edge portion where the first connecting wall meets the fourth exterior wall; a second edge portion where the first connecting wall meets the first exterior wall; a third edge portion where the fifth exterior wall meets the second connecting wall; a fourth edge portion where the second connecting wall meets the first exterior wall; a fifth edge portion where the first exterior wall meets the third exterior wall; and a sixth edge portion where the first exterior wall meets the sixth exterior wall;

wherein the collapsible bottle has a first corner portion where the second edge portion meets the first edge portion and the fifth edge portion; a second corner portion where the second edge portion meets the first edge portion and the sixth edge portion; a third corner portion where the fourth edge portion meets the third edge portion and the fifth edge portion; and a fourth corner portion where the fourth edge portion meets the third edge portion and the sixth edge portion;

wherein the second edge portion has a first intermediate portion that is spaced from the first edge portion and is located between the first corner portion and the second corner portion;

wherein, when the collapsible bottle is in the initial configuration, the first intermediate portion is closer to the first plane than the first corner portion is to the first plane, and the first intermediate portion is further from the second plane than the first corner portion is from the second plane;

wherein the fourth edge portion has a second intermediate portion that is spaced from the third edge portion and is located between the third corner portion and the fourth corner portion; and wherein, when the collapsible bottle is in the initial configuration, the second intermediate portion is closer to the first plane than the third corner portion is to the first plane, and the second intermediate portion is further from the second plane than the third corner portion is from the second plane.

8. The collapsible bottle according to claim 7, wherein the first connecting wall and the second connecting wall are substantially planar when the collapsible bottle is in the initial configuration.

9. The collapsible bottle according to claim 7, wherein, when the collapsible bottle is in the initial configuration, the first edge portion and the third edge portion are at least partially concave.

10. The collapsible bottle according to claim 7, wherein, when the collapsible bottle is in the initial configuration, the fifth edge portion is at least partially concave.

11. The collapsible bottle according to claim 7, wherein, when the collapsible bottle is in the initial configuration, the fifth edge portion is closer to the axis than the sixth edge portion is to the axis.

12. The collapsible bottle according to claim 7, wherein the first exterior wall is a rear wall of the collapsible bottle; the second exterior wall is a front wall of the collapsible bottle; the third exterior wall is a bottom wall of the collapsible bottle; the fourth exterior wall is a right side wall of the collapsible bottle; the fifth exterior wall is a left side wall of the collapsible bottle; and the sixth exterior wall is a top wall of the collapsible bottle.

13. The collapsible bottle according to claim 12, wherein, during the collapse of the collapsible bottle from the initial configuration towards the collapsed configuration, the sixth edge portion moves axially downwardly towards the neck.

14. The collapsible bottle according to claim 1, wherein the fluid is a hand cleaning fluid.

15. The collapsible bottle according to claim 2, wherein, as the collapsible bottle collapses, the first exterior wall moves towards the second exterior wall;

wherein the first exterior wall moves a greater distance towards the second exterior wall than the second exterior wall moves towards the first exterior wall as the collapsible bottle collapses; and wherein the first exterior wall has a convex shape when the collapsible bottle is in the initial configuration, and has a concave shape when the collapsible bottle is in the collapsed configuration.

16. The collapsible bottle according to claim 15, wherein the groove at least partially extends across the fourth exterior wall, the fifth exterior wall, and the sixth exterior wall; and wherein the groove is located where a third plane intersects the fourth exterior wall, the fifth exterior wall, and the sixth exterior wall, the third plane being parallel to the second plane.

17. The collapsible bottle according to claim 16, wherein the collapsible bottle has a first connecting wall that extends between the fourth exterior wall and the first exterior wall; and a second connecting wall that extends between the fifth exterior wall and the first exterior wall;

wherein the collapsible bottle has a first edge portion where the first connecting wall meets the fourth exterior wall; a second edge portion where the first connecting wall meets the first exterior wall; a third edge portion where the fifth exterior wall meets the second connecting wall; a fourth edge portion where the second connecting wall meets the first exterior wall; a fifth edge portion where the first exterior wall meets the third exterior wall; and a sixth edge portion where the first exterior wall meets the sixth exterior wall;

wherein the collapsible bottle has a first corner portion where the second edge portion meets the first edge portion and the fifth edge portion; a second corner portion where the second edge portion meets the first edge portion and the sixth edge portion; a third corner portion where the fourth edge portion meets the third edge portion and the fifth edge portion; and a fourth corner portion where the fourth edge portion meets the third edge portion and the sixth edge portion;

wherein the second edge portion has a first intermediate portion that is spaced from the first edge portion and is located between the first corner portion and the second corner portion;

wherein, when the collapsible bottle is in the initial configuration, the first intermediate portion is closer to the first plane than the first corner portion is to the first plane, and the first intermediate portion is further from the second plane than the first corner portion is from the second plane;

wherein the fourth edge portion has a second intermediate portion that is spaced from the third edge portion and is located between the third corner portion and the fourth corner portion;

wherein, when the collapsible bottle is in the initial configuration, the second intermediate portion is closer to the first plane than the third corner portion is to the first plane, and the second intermediate portion is further from the second plane than the third corner portion is from the second plane;

wherein the first connecting wall and the second connecting wall are substantially planar when the collapsible bottle is in the initial configuration;

wherein, when the collapsible bottle is in the initial configuration, the first edge portion and the third edge portion are at least partially concave;

wherein, when the collapsible bottle is in the initial configuration, the fifth edge portion is at least partially concave; and wherein, when the collapsible bottle is in the initial configuration, the fifth edge portion is closer to the axis than the sixth edge portion is to the axis.

18. The collapsible bottle according to claim 17, wherein the first exterior wall is a rear wall of the collapsible bottle; the second exterior wall is a front wall of the collapsible bottle; the third exterior wall is a bottom wall of the collapsible bottle; the fourth exterior wall is a right side wall of the collapsible bottle; the fifth exterior wall is a left side wall of the collapsible bottle; and the sixth exterior wall is a top wall of the collapsible bottle;

wherein, during the collapse of the collapsible bottle from the initial configuration towards the collapsed configuration, the sixth edge portion moves axially downwardly towards the neck; and wherein the fluid is a hand cleaning fluid.

* * * * *